US010526718B2

(12) United States Patent
James et al.

(10) Patent No.: US 10,526,718 B2
(45) Date of Patent: Jan. 7, 2020

(54) PLATING OF ARTICLES

(71) Applicant: The Royal Mint Limited, Llantrisant, Pontyclun (GB)

(72) Inventors: David Mathew James, Pontyclun (GB); Ellis Rhys Thomas, Pontyclun (GB); Gwilym Hibbert, Pontyclun (GB)

(73) Assignee: The Royal Mint Limited, Llantrisant, Pontyclun (GB)

( * ) Notice: Subject to any disclaimer, the term of this patent is extended or adjusted under 35 U.S.C. 154(b) by 395 days.

(21) Appl. No.: 14/890,333

(22) PCT Filed: May 9, 2014

(86) PCT No.: PCT/GB2014/051431

§ 371 (c)(1),
(2) Date: Mar. 25, 2016

(87) PCT Pub. No.: WO2014/181127

PCT Pub. Date: Nov. 13, 2014

(65) Prior Publication Data

US 2016/0122895 A1 May 5, 2016

(30) Foreign Application Priority Data

May 10, 2013 (GB) ..... 1308473.6

(51) Int. Cl.
*C25D 15/00* (2006.01)
*C25D 17/18* (2006.01)
(Continued)

(52) U.S. Cl.
CPC ..... *C25D 15/00* (2013.01); *C23C 18/1662* (2013.01); *C25D 3/12* (2013.01);
(Continued)

(58) Field of Classification Search
USPC ..... 205/109, 110
See application file for complete search history.

(56) References Cited

U.S. PATENT DOCUMENTS 3,268,424 A 8/1966 Brown et al.
3,916,937 A 11/1975 Nystrom
(Continued)

FOREIGN PATENT DOCUMENTS

CN 101838831 A 9/2010
EP 2182089 A1 5/2010
(Continued)

OTHER PUBLICATIONS

Yamamoto et al, Luminescence of rare-earth ions in perovskite-type oxide: from basic research to applications, Journal of Luminescence, vol. 100, No. 1-4, Dec. 2002, pp. 325-332 (Year: 2002).*
(Continued)

*Primary Examiner* — Harry D Wilkins, III
(74) *Attorney, Agent, or Firm* — Banner & Witcoff, Ltd.

(57) ABSTRACT

The present invention relates to the field of plating, including, but not limited to electroplating metallic articles, for example metallic discs that can be used as, or converted into, coins. Embodiments of the present invention described herein incorporate luminescent particles into plated metallic layers so that they can be detected for security purposes.

20 Claims, 11 Drawing Sheets

(51) Int. Cl.

| | |
|---|---|
| ***C23C 18/16*** | (2006.01) |
| ***C25D 7/00*** | (2006.01) |
| ***C25D 3/12*** | (2006.01) |
| ***C25D 3/22*** | (2006.01) |
| ***C25D 3/38*** | (2006.01) |
| ***C25D 21/10*** | (2006.01) |
| ***C25D 5/20*** | (2006.01) |
| ***C25D 3/30*** | (2006.01) |
| ***C25D 3/56*** | (2006.01) |
| ***C25D 5/48*** | (2006.01) |
| *B21J 5/02* | (2006.01) |
| *C25D 3/58* | (2006.01) |
| *C25D 5/36* | (2006.01) |

(52) U.S. Cl.

CPC ..... *C25D 3/22* (2013.01); *C25D 3/30* (2013.01); *C25D 3/38* (2013.01); *C25D 3/56* (2013.01); *C25D 5/20* (2013.01); *C25D 5/48* (2013.01); *C25D 7/00* (2013.01); *C25D 7/005* (2013.01); *C25D 17/18* (2013.01); *C25D 21/10* (2013.01); *B21J 5/02* (2013.01); *C23C 18/1651* (2013.01); *C23C 18/1653* (2013.01); *C25D 3/562* (2013.01); *C25D 3/565* (2013.01); *C25D 3/58* (2013.01); *C25D 5/36* (2013.01)

(56) References Cited

U.S. PATENT DOCUMENTS

| | | | | |
|---|---|---|---|---|
| 5,037,577 | A * | 8/1991 | Yamanoi ..... | C01F 17/0025 252/301.4 R |
| 5,391,277 | A | 2/1995 | Weng | |
| 2011/0114496 | A1* | 5/2011 | Dopp ..... | H01M 4/8631 205/109 |
| 2011/0305919 | A1 | 12/2011 | Conroy et al. | |
| 2012/0021120 | A1 | 1/2012 | Feldstein | |

FOREIGN PATENT DOCUMENTS

| | | | |
|---|---|---|---|
| EP | 2492376 | A1 | 8/2012 |
| JP | S6353299 | A | 3/1988 |
| KR | 100623784 | B1 | 9/2006 |
| KR | 20110137553 | A | 12/2011 |
| KR | 20120127569 | A | 11/2012 |
| RU | 2109855 | C1 | 4/1998 |
| RU | 2368709 | C2 | 9/2009 |
| WO | 2010144145 | A2 | 12/2010 |

OTHER PUBLICATIONS

Joseph et al, Photoluminescence studies on rare earth titanates prepared by self-propagating high temperature synthesis method, Spectrochimica Acta Part A: Molecular and Biomolecular Spectroscopy, vol. 71, No. 4, Dec. 2008, pp. 1281-1285 (Year: 2008 ).*

Ganapathi et al, Electrodeposition of luminescent composite metal coatings containing rare-earth phosphor particles, Journals of Materials Chemistry, vol. 22, No. 12, Feb. 2012, pp. 5514-5522 (Year: 2012).*

Dec. 4, 2014—(WO) International Search Report and Written Opinion—App. No. PCT/GB2014/051431—16 pages.

Das et al., "Co-deposition of Luminescent Particles with Electroless Nickel," Transactions of the Institute of Metal Finishing, Maney Publishing, vol. 4, No. 80, Jul. 1, 2002, 4 pages.

Ganapathi et al., "Electrodeposition of luminescent composite metal coatings containing rare-earth phosphor particles," Journal of Materials Chemistry, vol. 22, No. 12, Jan. 1, 2012, 9 pages.

Ropp, R.C., "Luminescence and the Solid State," Chapter 6, Second Edition, 168 pages.

Feldstein, M.D., "Composite Coatings with Light-Emitting Properties," Metal Finishing, vol. 97, Feb. 1999, 4 pages.

Smith et al., "Spatially Selective Electrochemical Deposition of Composite Films of Metal and Luminescent Si Nanoparticles," Chemical Physics Letters, vol. 372, 2003, 5 pages.

Apr. 24, 2018—(RU) Search Report—App. No. 2015152825—2 pages.

* cited by examiner

Figure 2. Signal vs. Size

| Run # | Size | Mean Particle Size | Signal |
|---|---|---|---|
| 21 | Small | 0.33 | 454 |
| 17 | Medium | 0.70 | 1262 |
| 1 | Large | 3.28 | 85 |

PLATING OF ARTICLES

CROSS REFERENCE TO RELATED APPLICATIONS

This application is a National Stage Application under 35 U.S.C. § 371 of co-pending PCT application number PCT/GB2014/051431, filed 9 May 2014; which claims priority to GB1308473.6, filed 10 May 2013, both of which are hereby incorporated by reference in their entireties for any and all non-limiting purposes.

TECHNICAL FIELD

The present invention relates to the field of plating, including, but not limited to electroplating metallic articles, for example metallic discs that can be used as, or converted into, coins. Embodiments of the present invention described herein incorporate luminescent particles into plated metallic layers so that they can be detected for security purposes.

BACKGROUND

The counterfeiting of coins (e.g., monetary currency and tokens) and other metal objects is an ongoing problem. (Coins may also be referred to herein as "coinage.") Many measures have been put into place to increase the difficulty with which coins can be counterfeited. This includes complex three-dimensional patterning on surfaces of the coins.

Other types of currency, such as bank notes, often include certain security features. These security features may include metallic strips, watermarks, holograms, fluorescent markers, optically variable inks, complex printed patterns, and embossing. However, it is more difficult, or impractical, to include similar security features in coins.

Coins are typically produced by mechanically stamping (also referred to as striking) a metal disc (or blank), to form a three-dimensional pattern on the disc, which provides the coin with its identity and denotes its value. Some recent methods of producing coins involve providing a coin blank, typically of a less expensive metal, and plating (e.g., electroplating or electroless plating) metals of higher value onto the coin blank. The plated coin blank can then be struck to form the final coin. For any security feature to be incorporated into such a coin, it should not affect the patterning of the coin, including the quality of its finish (of its plated surface), nor its structural integrity. The incorporation of a security feature into a coin should also be reasonably economical to avoid increasing the cost of coin production to unacceptable levels. The functioning of any security feature should also ideally last and remain sufficiently constant for the entire duration that a coin is in commercial (e.g., public) circulation, which in many cases is a number of years.

SUMMARY

In a first aspect, there is provided a method for plating articles, the method comprising providing a plating solution comprising a liquid medium, a precursor species suitable for forming a metallic layer on the articles, and a plurality of luminescent particles suspended in the liquid medium, at least some of which have a diameter of 10 μm or less; and plating the articles within the plating solution, such that the precursor species forms the metallic layer on the articles and the luminescent particles are deposited within the metallic layer while it is formed.

Optionally, before and/or during the plating of the articles, the plating solution is subjected to an ultrasound (also referred to as "ultrasonic" herein) treatment.

In a second aspect, there is provided a method for plating articles, the method comprising providing a plating solution comprising a liquid medium, a precursor species suitable for forming a metallic layer on the articles, and a plurality of luminescent particles suspended in the liquid medium; and plating the articles within the plating solution, such that the precursor species forms the metallic layer on the articles and the luminescent particles are deposited within the metallic layer while it is formed, wherein, before and/or during the plating of the articles, the plating solution is subjected to an ultrasound treatment.

In a third aspect, there is provided a method of making a patterned article, wherein the method comprises carrying out a method for plating articles according to the first or second aspects, and, after producing the plurality of plated articles, stamping a pattern onto at least one surface of each of the articles.

In a fourth aspect, there is provided a plating solution comprising a liquid medium, a precursor species for forming a metallic layer during a plating process, and a plurality of luminescent particles suspended in the liquid medium, at least some of which have a diameter of 10 μm or less.

In a fifth aspect, there is provided an article producible in accordance with the method of the first, second, and/or third aspect.

In a sixth aspect, there is provided an article having an electroplated metallic layer thereon, wherein luminescent particles are homogenously dispersed in the electroplated metallic layer, at least some of the luminescent particles having a diameter of 10 μm or less.

In a seventh aspect, there is provided an article having an electroplated metallic layer thereon, wherein luminescent particles are dispersed in the electroplated metallic layer in a first portion of the electroplated metallic layer, and a second portion of the electroplated metallic layer substantially absent of luminescent particles is disposed between the first portion and the article, wherein a depth of the second portion is less than 4 μm.

In an eighth aspect, there is provided an apparatus, which may be for carrying out the method of any of the aspects described herein.

Embodiments of the present invention incorporate luminescent particles (also referred to herein as "taggant particles" or simply "taggants" or "markers") within a plated (e.g., electro- or electroless plating) layer on an article to provide a security feature. In some embodiments, an electroplated layer is produced in which there is a homogenous distribution of the particles and a strong electromagnetic signal obtained from the luminescent particles. In some embodiments, the electroplated articles are stamped (e.g., mechanically) with a pattern, with no adverse effect on the quality of the pattern and its finish compared to an equivalent electroplated article that omits the luminescent particles from its plated layer. When plating with a solution in embodiments as described herein, before the luminescent particles are deposited, a layer of metal may first be laid down (i.e., plated) that is essentially free of luminescent particles. However, using techniques described herein, the depth of this particle-free layer can be reduced. Embodiments described herein are applicable to the production of coins or coin blanks (also referred to as "coinage").

The description of this specification includes the subject matters of each of the claims and of the claim combinations allowed by dependency.

DETAILED DESCRIPTION

Figure 1:
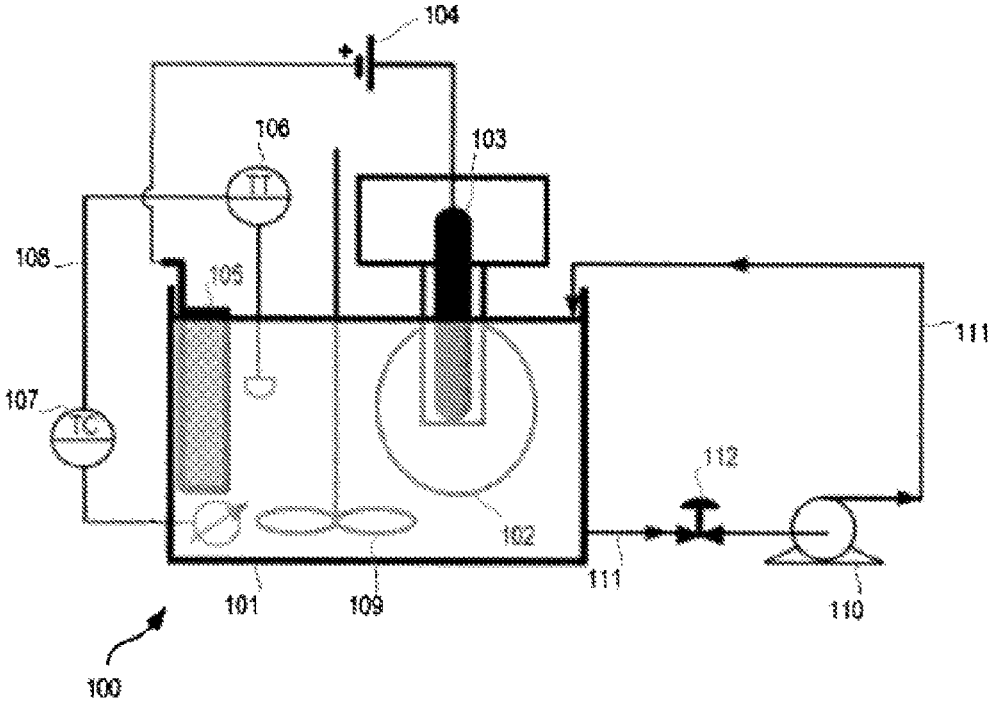
FIG. 1 shows schematically an example of an apparatus for carrying out embodiments of plating processes described herein.

It will be readily understood that the components of the present invention, as generally described and illustrated in the figures herein, may be arranged and designed in a wide variety of different configurations. Thus, the descriptions of the embodiments of the present invention, as represented in the figures, is not intended to limit the scope of the invention as claimed, but is merely representative of selected embodiments of the invention.

The features, structures, or characteristics of the invention described throughout this specification may be combined in any suitable manner in one or more embodiments. For example, the usage of the phrases "examples," "example embodiments," "some embodiments," "embodiments," or other similar language, throughout this specification refers to the fact that a particular feature, structure, or characteristic described in connection with the embodiment may be included in at least one embodiment of the present invention. Thus, appearances of the phrases "in embodiments," "example embodiments," "in some embodiments," "in other embodiments," or other similar language, throughout this specification do not necessarily all refer to the same group of embodiments, and the described features, structures, or characteristics may be combined in any suitable manner in one or more embodiments.

Embodiments of the present invention provide the previously mentioned aspects, including optional and preferred features of the various aspects as further described below. Unless otherwise stated, any optional or preferred feature may be combined with any other optional or preferred feature, and with any of the aspects of the invention mentioned herein.

Herein, "suspension," "colloidal suspension," "stable suspension," or any similar terminology generally refers to a mixture of two or more materials where at least one is dispersed in the other at a microscopic level, but not chemically bonded to it. The particles that act as the colloid in a suspension tend to be evenly distributed throughout the suspension if it has been recently mixed or stirred, but will settle to the bottom of the solution (also referred to herein as "sedimentation") due to gravity if it is allowed to sit undisturbed for an extended period of time.

Herein, "electroplating," "plating," "plating process," or any similar terminology refers to formation of a metallic layer on a substrate.

Plating methods described herein may involve the reduction of a precursor species comprising metal ions in the carrier medium, such that the metal ions form a metallic layer. A method utilized may be an electroplating method in which an electrical potential is applied to a plurality of articles, such that precursor species form a metallic layer. In embodiments, the method may involve electroless plating, wherein the precursor comprises metal ions, and the carrier medium further comprises a reducing agent, capable of chemically reducing the metal ions, such that they form a metallic layer.

The articles (before being plated) may be of any shape or size. In embodiments, the articles may be in the form of discs. The discs may be circular or of some other regular shape. The regular shape may, for example, be a shape having n sides, where n is 3 or more, and optionally n is selected from 3 to 15, optionally from 3 to 10, optionally from 3 to 12. If the articles have regular shapes, the sides of the shapes may be straight or curved. The discs may be apertured or non-apertured. In some embodiments, the disc may comprise an aperture, which may be located in a central portion of the face of the disc, and optionally extend the entire way through the disc. Optionally, the aperture may, for example, be for receiving a further smaller disc in the production of a bimetallic coin. The discs may have a thickness that is substantially the same across their entire face (or cross-section).

In an embodiment, the articles (before being plated) may be spherical or substantially, spherical, and may, before and/or after being plated, may be suitable for use as ball bearings.

In an embodiment, the articles, before and/or after being plated, are suitable for use as a component of a mechanical or electrical item, including, but not limited to any moving parts, any structural parts, electrically conductive parts, and/or any housing of the mechanical or electrical item. Mechanical or electrical items include, but are not limited to, watches, vehicles and aircraft.

The articles (before being plated) may comprise, consist essentially of, or consist of one or more first metal(s). The one or more first metal(s) may be in elemental form or in the form of an alloy. In an embodiment the one or more first metal(s) comprise a metal selected from Groups 3 to 14 of the Period Table, optionally from Groups 3 to 12 of the Periodic Table, and wherein the metal is in alloy or elemental form. In an embodiment, the first metal comprises a metal selected from iron, aluminium, copper, titanium, zinc, silver, gold, platinum, and wherein the metal is in alloy or elemental form. In embodiments, the one or more first metal(s) comprise iron. In embodiments, the one or more first metal(s) comprise steel. If the articles consist essentially of the first metal(s), the metal(s) may constitute at least 95 wt % (weight-weight percentage) of the article, optionally at least 98 wt % of the article, optionally at least 99 wt % of the article, optionally at least 99.5 wt % of the article.

The articles (before being plated) may comprise a core, which may comprise a metal or a non-metal, having one or more layers thereon, and the one or more layers may comprise a metal(s) different to that of the core and/or other layers.

In an embodiment, the articles before being plated in accordance with the method described herein, comprises a non-metal, and the non-metal may be plated using the method described herein using electroless plating, such that the metallic layer is formed on the non-metal and the luminescent particles are deposited within the metallic layer while it is formed. The non-metal may be selected from a plastic, a glass and a ceramic material.

In an embodiment, the articles, before being plated in accordance with the method described herein, comprise a non-metal, and the non-metal may be coated with, e.g. plated using electroless plating to form, a first layer of metal on the non-metal (the first layer of metal lacking the luminescent particles), and the articles then plated in accordance with the method described herein, e.g. using electroplating or electroless plating, to form a second layer of metal on the first layer of metal, the second layer of metal being the metallic layer in which the luminescent particles are deposited within while the metallic layer is formed.

In embodiments, the articles (before being plated) may be in the form of discs and comprise, consist essentially of, or consist of a first metal. The discs may have a diameter, as measured across a face of the disc, of from 0.5 cm to 10 cm, optionally from 0.5 cm to 5 cm, optionally from 0.5 cm to 3 cm. If the disc has a regular shape, the diameter may be the largest dimension across a face of the disc. The disc may have a thickness of from 0.3 mm to 10 mm, optionally from 0.3 mm to 5 mm, optionally from 0.3 mm to 2 mm.

The metallic layer that is plated (also referred to as the plated metal matrix) comprises a metal, which may be termed a second metal herein. The second metal may be selected from a transition metal. The second metal may be selected from zinc, copper, tin, nickel, and alloys of one or more thereof, including, but not limited to, brass. The metal components of the alloys may comprise, consist essentially of or consist of at least two of zinc, copper and nickel or alloys may comprise, consist essentially of or consist of at least two of zinc, copper, nickel and tin. The precursor species may comprise ions of the second metal, and one or more appropriate anions. Where the second metal comprises an alloy of two or more metals, the precursor may comprise ions of the different types of metal constituting the alloy. For example, where the second metal is brass, the precursor may comprise ions of copper and zinc, and optionally one or more other metals such as tin. In embodiments, the articles may comprise, consist essentially of, or consist of steel, and the metallic layer comprises a metal selected from zinc, copper, tin, nickel, and an alloy of one or more thereof. The metal components of the alloys may comprise, consist essentially of or consist of at least two of zinc, copper and nickel or alloys may comprise, consist essentially of or consist of at least two of zinc, copper, nickel and tin. The precursor material may comprise metal ions of the metal to be deposited in the metallic layer. The plating solution may comprise from 5 g/L to 150 g/L of metal ions that will form the metallic layer. The plating solution may comprise from 5 g/L to 150 g/L of metal ions, wherein the metal is selected from zinc, copper, tin, and nickel, and combinations thereof.

In embodiments, the plating solution may comprise from 5 g/L to 50 g/L of zinc ions, optionally from 10 g/L to 30 g/L of zinc ions, optionally from 15 g/L to 25 g/L of zinc ions, optionally from 16 g/L to 22 g/L of zinc ions. The precursor ions, that is the metal ions that will form the metallic layer, may be zinc ions or may be a mixture of zinc ions and one or more other metal ions, e.g. selected from copper ions, nickel ions and optionally tin ions, and a combination thereof. Where the precursor ions are zinc ions in combination with one or more other metal ions, the plating solution may comprise in total from 5 g/L to 150 g/L of metal ions that will form the metallic layer.

In embodiments, the plating solution may comprise from 10 g/L to 150 g/L of copper ions, optionally from 20 g/L to 120 g/L of copper ions, optionally from 20 g/L to 100 g/L of copper ions, optionally from 30 g/L to 90 g/L of copper ions. The precursor ions, that is the metal ions that will form the metallic layer, may be copper ions or may be a mixture of copper ions and one or more other metal ions, e.g. selected from zinc ions, nickel ions and optionally tin ions, and a combination thereof. Where the precursor ions are copper ions in combination with one or more other metal ions, the plating solution may comprise in total from 5 g/L to 150 g/L of metal ions that will form the metallic layer.

In embodiments, the plating solution may comprise from 10 g/L to 150 g/L of nickel ions, optionally from 30 g/L to 130 g/L of nickel ions, optionally from 40 to 120 g/L of nickel ions. The precursor ions, that is the metal ions that will form the metallic layer, may be nickel ions or may be a mixture of nickel ions and one or more other metal ions, e.g. selected from zinc ions, copper ions and optionally tin ions, and a combination thereof. Where the precursor ions are nickel ions in combination with one or more other metal ions, the plating solution may comprise in total from 5 g/L to 150 g/L of metal ions that will form the metallic layer.

The metallic layer, after plating onto the article(s), may have a thickness of at least 5 μm, optionally at least 10 μm, optionally at least 15 μm, optionally at least 20 μm, optionally at least 25 μm. The metallic layer may have a thickness of from 5 μm to 50 μm, optionally from 10 μm to 40 μm, optionally from 15 μm to 35 μm, optionally from 15 μm to 35 μm, optionally from 15 μm to 30 μm, optionally from 20 to 30 μm. The depth of the metallic plating may be measured using any suitable technique, including, but not limited to x-ray fluorescence ("XRF") and scanning electron microscopy ("SEM").

The plating may be carried out while the articles are within a receptacle that is placed within the container of plating solution. In embodiments, the receptacle moves within the plating solution. The receptacle may act to tumble the articles within the receptacle during the plating. In embodiments, the receptacle rotates within the plating solution. Such a receptacle may be in the form of a barrel. This may be termed barrel plating. The articles may be free to move within the receptacle (e.g., barrel) such that when the receptacle rotates, the articles move (e.g., rotate and/or tumble) within the receptacle relative to one another. This has been found to provide a relatively consistent plate thickness on all sides of the articles.

In embodiments of the present invention, the plating is carried out while the articles are within a receptacle that moves continuously during the plating process. The plating may be carried out while the articles are within a receptacle that rotates continuously during the plating process. The receptacle may rotate on an axis that is substantially horizontal. The receptacle may move (e.g., rotate) at a constant rate during the plating. Optionally, the articles are continuously rotated in a barrel, and optionally at a constant rate, during the plating of the plurality of articles. Optionally, the rotation of the barrel is periodically interrupted. The receptacle (e.g., barrel) may rotate at a speed of 1 to 50 rpm, optionally from 4 to 30 rpm, optionally from 4 to 15 rpm, optionally from 4 to 12 rpm, optionally from 6 to 10 rpm, optionally about 8 rpm. The rate of rotation may be varied during plating or be held constant, for example for the entire duration of the plating.

In some embodiments, an electrical potential is applied to the articles, such that they form a cathode within the plating solution, and a further electrode is present within the plating solution that forms an anode. The anode may be in any suitable form. In some embodiments, the anode comprises a metallic mesh material, which may form a basket. If the articles are within a receptacle as described above, the receptacle may comprise or be formed out of a non-conducting material, such as plastic, and an electrode may extend into the receptacle, this electrode acting as a cathode during plating. The electrode acting as a cathode may contact at least some of the articles within the receptacle during plating.

Luminescent, or fluorescent, materials or particles (fluorescent particles are a subset of luminescent particles) described herein may absorb light at a first wavelength and then emit light at a second wavelength, which may be shorter ("anti-Stokes emission") or longer ("Stokes emission") than the first wavelength, or substantially the same as the first wavelength. The luminescent particles may absorb light in the infrared ("IR"), visible, or ultraviolet ("UV") range, for example in the range of 200 nm to 5 μm of the electromagnetic spectrum.

Luminescent particles may be or comprise a phosphor material. Phosphors materials are typically comprised of a host, typically comprised of a crystalline lattice, doped with luminescence centers comprised of trace amount of dopants, usually comprised of a transition metal, lanthanides, or actinides. A description of the design, synthesis, and optical characteristics of phosphors is provided in Chapter 6 of "Luminescence and the Solid State" by R. C. Ropp, second edition, which is hereby incorporated by reference herein.

In embodiments, the luminescent materials may comprise an inorganic phosphor, for example a phosphor selected from an yttrium aluminum garnet ("YAG") phosphor. The YAG phosphor may comprise yttrium aluminum garnet doped with a metal, for example a metal selected from a transition metal, a lanthanide, and an actinide. The YAG phosphor may comprise yttrium aluminum garnet doped with a metal selected from Ce, Nd, Tb, Sm, Dy, and Cr(IV).

Figure 2:
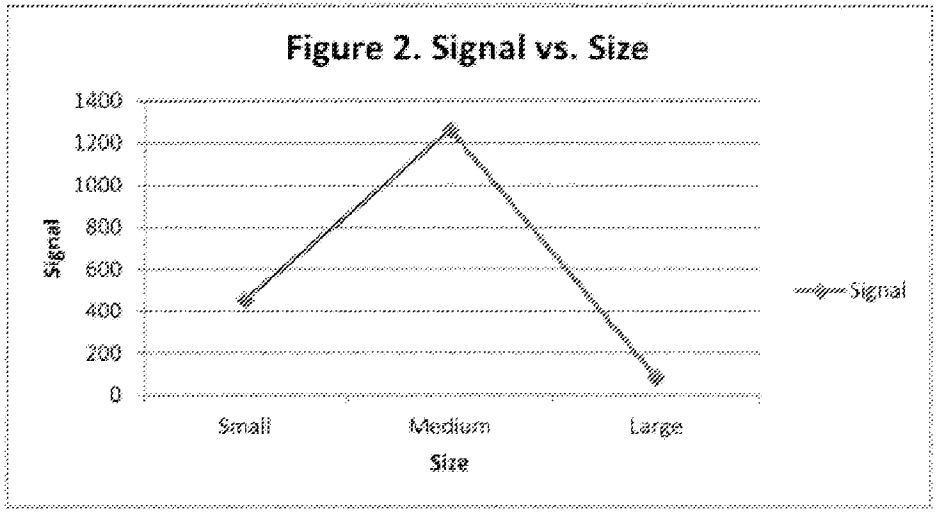
FIG. 2 shows a variance of luminescent signal strength with the sizes of luminescent particles.

In embodiments of the present invention, at least some of the luminescent particles have a diameter of 10 μm or less, optionally 5 μm or less, optionally 3 μm or less, optionally 2 μm or less. In embodiments, at least some of the luminescent particles have a diameter of from 0.5 μm to 1 μm, optionally from 0.6 μm to 1 μm, optionally from 0.7 μm to 0.9 μm, optionally about 0.8 μm. As further described in the Examples herein, particle size can have an effect on, amongst other factors, the luminescent signal emitted from the luminescent particles once incorporated in the plated layer. As shown in FIG. 2, luminescent particles having diameters of from approximately 0.5 μm to 1 μm were found to have the strongest (highest) luminescent signals, and did not appear to affect the surface quality (e.g., quality of finish of the surface) of the articles even after they had been struck into coins. They also allowed for a relatively stable suspension of the luminescent particles when in the plating solution.

The diameter (and correspondingly, determinations of the mean diameters) of a luminescent particle and/or any particle size distribution measurements may be measured using any suitable technique, including, but not limited to, scanning electron micrograph ("SEM"), and/or laser light scattering, for example in accordance with ASTM UOP856-07. The diameter of a luminescent particle may be the largest dimension measured across the particle. ASTM UOP856-07 is a well-known standardized method for determining the particle size distribution of powders and slurries using laser light scattering. This standard is commercially available from ASTM International. The laser light scattering measurements in accordance with this standard may be performed with a Microtrac Model S3500 instrument commercially available from Microtrac Inc., or a Malvern Instruments Mastersizer 3000. In embodiments, the luminescent particles may be characterised as described in ASTM F1877-05 (2010). The particle size distribution measured in accordance with ASTM UOP856-07, e.g. for D50, D90 and D99, may be defined as the volume particle size distribution. The mean particle size, measured in accordance with ASTM UOP856-07, may be defined as the volumetric mean particle size.

Luminescent particles utilized in plating processes described herein may have a mean diameter of 10 μm or less, optionally 5 μm or less, optionally 3 μm or less, optionally 2 μm or less. In embodiments, the luminescent particles may have a mean diameter of from 0.5 μm to 5 μm, e.g. 0.5 μm to 1 μm, optionally from 0.6 μm to 1 μm, optionally from 0.7 μm to 0.9 μm, optionally about 0.8 μm. The mean diameter of the particles may be measured before the particles are incorporated into the plating solution.

Luminescent particles utilized in plating processes described herein may have a D50 distribution of 10 μm or less, optionally 5 μm or less, optionally 3 μm or less, optionally 2 μm or less. A D50 distribution is defined as 50% of the population of particles having sizes less than the D50 value, and 50% of the population of particles having sizes greater than the D50 value. In embodiments, the luminescent particles have a D50 distribution of from 0.5 μm to 1 μm, optionally from 0.6 μm to 1 μm, optionally from 0.7 μm to 0.9 μm, optionally about 0.8 μm. The D50 distribution of the particles may be measured before the particles are incorporated into the plating solution. D50 is sometimes termed $d_{50}$ in the art.

Luminescent particles utilized in plating processes described herein may have a D90 distribution of 10 μm or less, optionally 5 μm or less, optionally 3 μm or less, optionally 2 μm or less, optionally 1 μm or less. A D90 distribution is defined as 90% of the population of particles having sizes less than the D90 value, and 10% of the population of particles having sizes greater than the D90 value. The luminescent particles may have a D90 distribution of from 0.5 μm to 5 μm, optionally from 1 μm to 4 μm, optionally from 1 μm to 3 μm. The D90 distribution of the particles may be measured before the particles are incorporated into the plating solution. D90 is sometimes termed $d_{90}$ in the art.

In embodiments, luminescent particles, for example in the plating solution and/or in the articles described herein, lack or substantially lack particles having a diameter of 10 μm or more, optionally 8 μm or more, optionally 7 μm or more, optionally 5 μm or more, optionally 4 μm or more, optionally 3 μm or more. "Substantially lack" may indicate 5 wt % of the particles or less, optionally 2 wt % or less, optionally 1 wt % or less have the stated diameter. Optionally, the particles may have a D99 distribution of 10 μm or less, optionally 8 μm or less, optionally 7 μm or less, optionally 5 μm or more, optionally 4 μm or less, optionally 3 μm or less. A D99 distribution is defined as 99% of the population of particles having sizes less than the D99 value, and 1% of the population of particles having sizes greater than the D99 value. Optionally, the particles may have a D99 of from 10 μm to 3 μm, optionally from 7 μm to 3 μm, optionally from 5 μm to 3 μm.

In embodiments, luminescent particles may have a density of at least 2 kg/dm$^3$, optionally at least 3 kg/dm$^3$, optionally at least 4 kg/dm$^3$, optionally at least 5 kg/dm$^3$. In embodiments, luminescent particles may have a density of from least 2 kg/dm$^3$ to 9 kg/dm$^3$, optionally from 3 kg/dm$^3$ to 9 kg/dm$^3$, optionally from 4 kg/dm$^3$ to 9 kg/dm$^3$, optionally from 5 kg/dm$^3$ to 9 kg/dm$^3$.

The luminescent particles may have a combination of size and density as listed in any of Tables A, B and C below. The diameter, D50 distribution and D90 distribution referred to in Tables A-C may be measured as described previously herein. In particular, the diameter, D50 distribution and D90 distribution are measured using laser light scattering, for example in accordance with ASTM UOP856-07.

TABLE A

| Feature | Mean Diameter | Density |
|---|---|---|
| A | 5 μm or less | at least 2 kg/dm$^3$ |
| B | 5 μm or less | at least 3 kg/dm$^3$ |
| C | 5 μm or less | at least 4 kg/dm$^3$ |
| D | 5 μm or less | at least 5 kg/dm$^3$ |
| E | 5 μm or less | 2 kg/dm$^3$ to 9 kg/dm$^3$ |
| F | 5 μm or less | 3 kg/dm$^3$ to 9 kg/dm$^3$ |
| G | 5 μm or less | 4 kg/dm$^3$ to 9 kg/dm$^3$ |
| H | 5 μm or less | 5 kg/dm$^3$ to 9 kg/dm |
| I | 3 μm or less | at least 2 kg/dm$^3$ |
| J | 3 μm or less | at least 3 kg/dm$^3$ |
| K | 3 μm or less | at least 4 kg/dm$^3$ |
| L | 3 μm or less | at least 5 kg/dm$^3$ |
| M | 3 μm or less | 2 kg/dm$^3$ to 9 kg/dm$^3$ |
| N | 3 μm or less | 3 kg/dm$^3$ to 9 kg/dm$^3$ |
| O | 3 μm or less | 4 kg/dm$^3$ to 9 kg/dm$^3$ |
| P | 3 μm or less | 5 kg/dm$^3$ to 9 kg/dm |
| Q | 0.5 μm to 1 μm | at least 2 kg/dm$^3$ |
| R | 0.5 μm to 1 μm | at least 3 kg/dm$^3$ |
| S | 0.5 μm to 1 μm | at least 4 kg/dm$^3$ |
| T | 0.5 μm to 1 μm | at least 5 kg/dm$^3$ |
| U | 0.5 μm to 1 μm | 2 kg/dm$^3$ to 9 kg/dm$^3$ |
| V | 0.5 μm to 1 μm | 3 kg/dm$^3$ to 9 kg/dm$^3$ |
| W | 0.5 μm to 1 μm | 4 kg/dm$^3$ to 9 kg/dm$^3$ |
| X | 0.5 μm to 1 μm | 5 kg/dm$^3$ to 9 kg/dm |
| Y | 0.7 μm to 0.9 μm | at least 2 kg/dm$^3$ |
| Z | 0.7 μm to 0.9 μm | at least 3 kg/dm$^3$ |
| AA | 0.7 μm to 0.9 μm | at least 4 kg/dm$^3$ |
| AB | 0.7 μm to 0.9 μm | at least 5 kg/dm$^3$ |
| AC | 0.7 μm to 0.9 μm | 2 kg/dm$^3$ to 9 kg/dm$^3$ |
| AD | 0.7 μm to 0.9 μm | 3 kg/dm$^3$ to 9 kg/dm$^3$ |
| AE | 0.7 μm to 0.9 μm | 4 kg/dm$^3$ to 9 kg/dm$^3$ |
| AF | 0.7 μm to 0.9 μm | 5 kg/dm$^3$ to 9 kg/dm |

TABLE B

| Feature | D50 distribution | Density |
|---|---|---|
| BA | 5 μm or less | at least 2 kg/dm$^3$ |
| BB | 5 μm or less | at least 3 kg/dm$^3$ |
| BC | 5 μm or less | at least 4 kg/dm$^3$ |
| BD | 5 μm or less | at least 5 kg/dm$^3$ |
| BE | 5 μm or less | 2 kg/dm$^3$ to 9 kg/dm$^3$ |
| BF | 5 μm or less | 3 kg/dm$^3$ to 9 kg/dm$^3$ |
| BG | 5 μm or less | 4 kg/dm$^3$ to 9 kg/dm$^3$ |
| BH | 5 μm or less | 5 kg/dm$^3$ to 9 kg/dm |
| BI | 3 μm or less | at least 2 kg/dm$^3$ |
| BJ | 3 μm or less | at least 3 kg/dm$^3$ |

TABLE B-continued

| Feature | D50 distribution | Density |
|---|---|---|
| BK | 3 μm or less | at least 4 kg/dm$^3$ |
| BL | 3 μm or less | at least 5 kg/dm$^3$ |
| BM | 3 μm or less | 2 kg/dm$^3$ to 9 kg/dm$^3$ |
| BN | 3 μm or less | 3 kg/dm$^3$ to 9 kg/dm$^3$ |
| BO | 3 μm or less | 4 kg/dm$^3$ to 9 kg/dm$^3$ |
| BP | 3 μm or less | 5 kg/dm$^3$ to 9 kg/dm |
| BQ | 0.5 μm to 1 μm | at least 2 kg/dm$^3$ |
| BR | 0.5 μm to 1 μm | at least 3 kg/dm$^3$ |
| BS | 0.5 μm to 1 μm | at least 4 kg/dm$^3$ |
| BT | 0.5 μm to 1 μm | at least 5 kg/dm$^3$ |
| BU | 0.5 μm to 1 μm | 2 kg/dm$^3$ to 9 kg/dm$^3$ |
| BV | 0.5 μm to 1 μm | 3 kg/dm$^3$ to 9 kg/dm$^3$ |
| BW | 0.5 μm to 1 μm | 4 kg/dm$^3$ to 9 kg/dm$^3$ |
| BX | 0.5 μm to 1 μm | 5 kg/dm$^3$ to 9 kg/dm |
| BY | 0.7 μm to 0.9 μm | at least 2 kg/dm$^3$ |
| BZ | 0.7 μm to 0.9 μm | at least 3 kg/dm$^3$ |
| CA | 0.7 μm to 0.9 μm | at least 4 kg/dm$^3$ |
| CB | 0.7 μm to 0.9 μm | at least 5 kg/dm$^3$ |
| CC | 0.7 μm to 0.9 μm | 2 kg/dm$^3$ to 9 kg/dm$^3$ |
| CD | 0.7 μm to 0.9 μm | 3 kg/dm$^3$ to 9 kg/dm$^3$ |
| CE | 0.7 μm to 0.9 μm | 4 kg/dm$^3$ to 9 kg/dm$^3$ |
| CF | 0.7 μm to 0.9 μm | 5 kg/dm$^3$ to 9 kg/dm |

TABLE C

| Feature | D90 distribution | Density |
|---|---|---|
| DA | 5 μm or less | at least 2 kg/dm$^3$ |
| DB | 5 μm or less | at least 3 kg/dm$^3$ |
| DC | 5 μm or less | at least 4 kg/dm$^3$ |
| CD | 5 μm or less | at least 5 kg/dm$^3$ |
| DE | 5 μm or less | 2 kg/dm$^3$ to 9 kg/dm$^3$ |
| DF | 5 μm or less | 3 kg/dm$^3$ to 9 kg/dm$^3$ |
| DG | 5 μm or less | 4 kg/dm$^3$ to 9 kg/dm$^3$ |
| DH | 5 μm or less | 5 kg/dm$^3$ to 9 kg/dm |
| DI | 3 μm or less | at least 2 kg/dm$^3$ |
| DJ | 3 μm or less | at least 3 kg/dm$^3$ |
| DK | 3 μm or less | at least 4 kg/dm$^3$ |
| DL | 3 μm or less | at least 5 kg/dm$^3$ |
| DM | 3 μm or less | 2 kg/dm$^3$ to 9 kg/dm$^3$ |
| DN | 3 μm or less | 3 kg/dm$^3$ to 9 kg/dm$^3$ |
| DO | 3 μm or less | 4 kg/dm$^3$ to 9 kg/dm$^3$ |
| DP | 3 μm or less | 5 kg/dm$^3$ to 9 kg/dm |
| DQ | 0.5 μm to 5 μm | at least 2 kg/dm$^3$ |
| DR | 0.5 μm to 5 μm | at least 3 kg/dm$^3$ |
| DS | 0.5 μm to 5 μm | at least 4 kg/dm$^3$ |
| DT | 0.5 μm to 5 μm | at least 5 kg/dm$^3$ |
| DU | 0.5 μm to 5 μm | 2 kg/dm$^3$ to 9 kg/dm$^3$ |
| DV | 0.5 μm to 5 μm | 3 kg/dm$^3$ to 9 kg/dm$^3$ |
| DW | 0.5 μm to 5 μm | 4 kg/dm$^3$ to 9 kg/dm$^3$ |
| DX | 0.5 μm to 5 μm | 5 kg/dm$^3$ to 9 kg/dm |
| DY | 1 μm to 3 μm | at least 2 kg/dm$^3$ |
| DZ | 1 μm to 3 μm | at least 3 kg/dm$^3$ |
| EA | 1 μm to 3 μm | at least 4 kg/dm$^3$ |
| EB | 1 μm to 3 μm | at least 5 kg/dm$^3$ |
| EC | 1 μm to 3 μm | 2 kg/dm$^3$ to 9 kg/dm$^3$ |
| ED | 1 μm to 3 μm | 3 kg/dm$^3$ to 9 kg/dm$^3$ |
| EE | 1 μm to 3 μm | 4 kg/dm$^3$ to 9 kg/dm$^3$ |
| EF | 1 μm to 3 μm | 5 kg/dm$^3$ to 9 kg/dm |

In embodiments, the luminescent particles may be present in the plating solution in an amount of 1 gram (g) or more of luminescent particles per Litre (L) of plating solution (i.e., 1 g/L or more), optionally 2 g/L or more, optionally 3 g/L or more, optionally 4 g/L or more, optionally 5 g/L or more. In embodiments, the luminescent particles may be present in the plating solution in an amount of 10 g or less of luminescent particles per L of plating solution (i.e., 10 g/L or less), optionally 8 g/L or less, optionally 7 g/L or less, optionally 6 g/L or less, optionally 5 g/L or less. In embodiments, the luminescent particles may be present in the plating solution in an amount of 1 g to 10 g luminescent particles per L of plating solution (i.e., 1 g/L to 10 g/L), optionally 2 g/L to 8 g/L, optionally 3 g/L to 6 g/L. Therefore, this specification hereby discloses a combination of each amount or range mentioned in this paragraph with each item of information herein relating to luminescent particle size and with each of the following features of Tables A, B and C: A, B, C, D, E, F, G, H, I, J, K, L, M, N, O, P, Q, R, S, T, U, V, W, X, Y, Z, AA, A, AC, AD, AE, AF, BA, BB, BC, BD, BE, BF, BG, BH, BI, BJ, BK, BL, BM, BN, BO, BP, BQ, BR, BS, BT, BU, BV, BW, BX, BY, BZ, CA, CB, CC, CD, CE, CF, DA, DB, DC, DD, DE, DF, DG, DH, DI, DJ, DK, DL, DM, DN, DO, DP, DQ, DR, DS, DT, DU, DV, DW, DX, DY, DZ, EA, EB, EC, ED, EE, EF.

The type of liquid medium utilized in embodiments of the present invention is not particularly restricted. The liquid medium may comprise or be water. The plating solution may be at a pH of from 2 to 6, optionally a pH of from 3 to 5, optionally a pH of from 3.5 to 4.5, optionally about 4.

The electric current density while plating the plurality of articles may be from 0.1 A/dm$^2$ to 1.5 A/dm$^2$, optionally from 0.3 A/dm$^2$ to 1 A/dm$^2$, optionally from 0.3 A/dm$^2$ to 0.5 A/dm$^2$, optionally about 0.4 A/dm$^2$. Therefore, this specification hereby discloses a combination of each amount or range mentioned in this paragraph with each item of information herein relating to luminescent particle size and with each of the following features of Tables A, B and C: A, B, C, D, E, F, G, H, I, J, K, L, M, N, O, P, Q, R, S, T, U, V, W, X, Y, Z, AA, A, AC, AD, AE, AF, BA, BB, BC, BD, BE, BF, BG, BH, BI, BJ, BK, BL, BM, BN, BO, BP, BQ, BR, BS, BT, BU, BV, BW, BX, BY, BZ, CA, CB, CC, CD, CE, CF, DA, DB, DC, DD, DE, DF, DG, DH, DI, DJ, DK, DL, DM, DN, DO, DP, DQ, DR, DS, DT, DU, DV, DW, DX, DY, DZ, EA, EB, EC, ED, EE, EF.

In embodiments of the present invention, before or during plating of the plurality of articles, the plating solution may be subjected to an ultrasound, or ultrasonic, ("US") treatment (also referred to herein as sonication). Subjecting the plating solution to ultrasound treatment before the plating process commences was found to produce a very stable suspension of the particles in the plating solution, which in turn led to higher luminescent signals from the luminescent particles in the final plated articles. Subjecting the plating solution to ultrasound treatment during the plating process was found in embodiments to reduce the depth of the initial luminescent particle-free portion (layer) of the metallic layer (see, e.g., layer B in FIG. 3). Such an initial layer is a natural result of the plating process in which this initial nucleation, or seed, layer becomes deposited first with only the metal particles as the metal cations from the plating solution undergo an electronic reduction on the surface of the cathode (i.e., the article being plated) to form the metallic plated layer. After this initial layer forms, then the luminescent particles will be incorporated into the growing metal matrix (the metal plated layer) as they come in contact with the cathode surface as a result of being suspended in the plating solution. Since this initial luminescent particle-free portion is non-functional (i.e., does not emit electromagnetic energy), it is desired in embodiments that the thickness, or depth, of this initial layer be minimized.

The plating solution may be subjected to ultrasound treatment before commencing the formation of the metallic layer (i.e., plating process) (e.g., for a period of at least 30 minutes), optionally for a period of at least 1 hour before commencing the formation of the metallic layer, optionally for a period of at least 3 hours before commencing the formation of the metallic layer, optionally for a period of at least 4 hours before commencing the formation of the metallic layer, optionally for a period of at least 5 hours before commencing the formation of the metallic layer.

The ultrasound treatment may be applied during the plating process for the whole period of the plating or during only part of the period of the plating. The ultrasound may be applied during an initial period of the plating, for example for a period of from 5 minutes to an hour, for example for a period of from 15 minutes to an hour from commencement of the plating of the articles, with the entire plating process taking 2 hours or more, or until a desired depth of the metallic layer is deposited on the substrate of the article (e.g., disc). For example, the ultrasound treatment may be applied for a period of at least 15 minutes from commencement of the plating of the articles. In embodiments, after the plating solution has been subjected to the ultrasound treatment during plating of the articles, the plating of the articles continues until a predetermined depth of the metallic layer has been deposited on the articles. The ultrasound treatment may be applied during the treatment for a time mentioned in this paragraph and before the treatment for a time mentioned in the immediately preceding paragraph.

Before and/or during the plating process, the frequency of the applied ultrasound treatment may be at least 10 kHz, optionally at least 15 kHz, optionally from 10 kHz to 30 kHz, optionally from 15 kHz to 25 kHz, optionally about 20 kHz. The ultrasound frequency as disclosed in this paragraph may be applied before the treatment for a time previously disclosed herein. The ultrasound frequency as disclosed in this paragraph may be applied during the treatment for a time previously disclosed herein. The ultrasound frequency as disclosed in this paragraph may be applied before the treatment for a time previously disclosed herein and during the treatment for a time previously disclosed herein.

Before and/or during the plating process, the power of the applied ultrasound treatment may be at least 100 W, optionally at least 200 W, e.g. at least 1000 W, optionally at least 1400 W. Before or during the plating process, the power of the applied ultrasound treatment may be a value from 100 W to 2000 W (e.g. 1000 W or 1400 W to 2000 W), optionally a value from 100 W to 1800 W, optionally a value from 200 W to 700 W, optionally about 500 W. The ultrasound power as disclosed in this paragraph may be applied before the treatment for a time previously disclosed herein. The ultrasound power as disclosed in this paragraph may be applied during the treatment for a time previously disclosed herein. The ultrasound power as disclosed in this paragraph may be applied before the treatment for a time previously disclosed herein and during the treatment for a time previously disclosed herein.

Ultrasound treatment applied before the process, ultrasound treatment applied during the process or ultrasound treatment as applied both before and during the process may be applied at a combination of frequency and power disclosed in the following Table D:

TABLE D

| Frequency | Power |
|---|---|
| at least 10 kHz | at least 100 W |
| at least 15 kHz | at least 100 W |
| from 10 kHz to 30 kHz | at least 100 W |
| from 15 kHz to 25 kHz | at least 100 W |
| about 20 kHz | at least 100 W |
| at least 10 kHz | at least 200 W |
| at least 15 kHz | at least 200 W |
| from 10 kHz to 30 kHz | at least 200 W |

TABLE D-continued

| Frequency | Power |
|---|---|
| from 15 kHz to 25 kHz | at least 200 W |
| about 20 kHz | at least 200 W |
| from 10 kHz to 30 kHz | at least 200 W |
| at least 10 kHz | at least 1400 W |
| at least 15 kHz | at least 1400 W |
| from 10 kHz to 30 kHz | at least 1400 W |
| from 15 kHz to 25 kHz | at least 1400 W |
| about 20 kHz | at least 1400 W |
| at least 10 kHz | from 100 W to 2000 W |
| at least 15 kHz | from 100 W to 2000 W |
| from 10 kHz to 30 kHz | from 100 W to 2000 W |
| from 15 kHz to 25 kHz | from 100 W to 2000 W |
| about 20 kHz | from 100 W to 2000 W |
| at least 10 kHz | from 100 W to 1800 W |
| at least 15 kHz | from 100 W to 1800 W |
| from 10 kHz to 30 kHz | from 100 W to 1800 W |
| from 15 kHz to 25 kHz | from 100 W to 1800 W |
| about 20 kHz | from 100 W to 1800 W |
| at least 10 kHz | from 200 W to 700 W |
| at least 15 kHz | from 200 W to 700 W |
| from 10 kHz to 30 kHz | from 200 W to 700 W |
| from 15 kHz to 25 kHz | from 200 W to 700 W |
| about 20 kHz | from 200 W to 700 W |
| at least 10 kHz | about 500 W |
| at least 15 kHz | about 500 W |
| from 10 kHz to 30 kHz | about 500 W |
| from 15 kHz to 25 kHz | about 500 W |
| about 20 kHz | about 500 W |
| at least 10 kHz | about 500 W |
| at least 15 kHz | about 500 W |
| from 10 kHz to 30 kHz | about 500 W |
| from 15 kHz to 25 kHz | about 500 W |
| about 20 kHz | about 500 W |

The ultrasound treatment as disclosed in Table D may be applied before the treatment for a time previously disclosed herein. The ultrasound treatment as disclosed in Table D may be applied during the treatment for a time previously disclosed herein. The ultrasound treatment as disclosed in Table D may be applied before the treatment for a time previously disclosed herein and during the treatment for a time previously disclosed herein.

The ultrasound treatment disclosed in each row of Table D may be combined with an electric current density while plating the plurality of articles of from 0.1 A/dm$^2$ to 1.5 A/dm$^2$, optionally from 0.3 A/dm$^2$ to 1 A/dm$^2$, optionally from 0.3 A/dm$^2$ to 0.5 A/dm$^2$, optionally about 0.4 A/dm$^2$.

This specification hereby discloses a combination of ultrasound frequency mentioned in this specification with each item of information herein relating to luminescent particle size and with each of the following features of Tables A, B and C: A, B, C, D, E, F, G, H, I, J, K, L, M, N, O, P, Q, R, S, T, U, V, W, X, Y, Z, AA, A, AC, AD, AE, AF, BA, BB, BC, BD, BE, BF, BG, BH, BI, BJ, BK, BL, BM, BN, BO, BP, BQ, BR, BS, BT, BU, BV, BW, BX, BY, BZ, CA, CB, CC, CD, CE, CF, DA, DB, DC, DD, DE, DF, DG, DH, DI, DJ, DK, DL, DM, DN, DO, DP, DQ, DR, DS, DT, DU, DV, DW, DX, DY, DZ, EA, EB, EC, ED, EE, EF.

This specification hereby discloses a combination of ultrasound power mentioned in this specification with each item of information herein relating to luminescent particle size and with each of the following features of Tables A, B and C: A, B, C, D, E, F, G, H, I, J, K, L, M, N, O, P, Q, R, S, T, U, V, W, X, Y, Z, AA, A, AC, AD, AE, AF, BA, BB, BC, BD, BE, BF, BG, BH, BI, BJ, BK, BL, BM, BN, BO, BP, BQ, BR, BS, BT, BU, BV, BW, BX, BY, BZ, CA, CB, CC, CD, CE, CF, DA, DB, DC, DD, DE, DF, DG, DH, DI, DJ, DK, DL, DM, DN, DO, DP, DQ, DR, DS, DT, DU, DV, DW, DX, DY, DZ, EA, EB, EC, ED, EE, EF.

This specification hereby discloses a combination of the features of each row of Table D above with each item of information herein relating to luminescent particle size and with each of the following features of Tables A, B and C: A, B, C, D, E, F, G, H, I, J, K, L, M, N, O, P, Q, R, S, T, U, V, W, X, Y, Z, AA, A, AC, AD, AE, AF, BA, BB, BC, BD, BE, BF, BG, BH, BI, BJ, BK, BL, BM, BN, BO, BP, BQ, BR, BS, BT, BU, BV, BW, BX, BY, BZ, CA, CB, CC, CD, CE, CF, DA, DB, DC, DD, DE, DF, DG, DH, DI, DJ, DK, DL, DM, DN, DO, DP, DQ, DR, DS, DT, DU, DV, DW, DX, DY, DZ, EA, EB, EC, ED, EE, EF.

In embodiments of the present invention, the plating solution may be stirred, e.g. in the container in which the plating of the articles is carried out, at a speed below the critical angular speed at which a vortex is formed within the plating solution. In fluid dynamics, a vortex is a region within a fluid where the flow is mostly a spinning motion about an imaginary axis, straight or curved. In embodiments, the plating solution is stirred by a stirrer rotating at a speed below 1800 rpm. In embodiments, the plating solution is stirred by a stirrer rotating at a speed of from 500 to 1800 rpm. In embodiments of the present invention, stirring the plating solution below the critical angular speed at which a vortex would form in the plating solution is a stir speed that creates sufficient turbulence in the plating solution to prevent agglomeration of particles, but allows co-deposition of the luminescent particles and the plated metal.

In a further aspect, there is provided a method for plating articles, the method comprising providing a plating solution comprising a liquid medium, a precursor species suitable for forming a metallic layer on the articles, and a plurality of luminescent particles suspended in the liquid medium; and plating the articles within the plating solution, such that the precursor species forms the metallic layer on the articles and the luminescent particles are deposited within the metallic layer while it is formed, wherein, before and/or during the plating of the articles, the plating solution is agitated.

In an embodiment, in any of the aspects described herein, the plating solution may be agitated before and/or during the formation of the metallic layer (i.e., plating process). In an embodiment, the plating solution is agitated by subjecting the plating solution to high shear. High shear may be defined as any turbulent movement of the plating solution, preferably turbulent flow that can cause deagglomeration of agglomerated luminescent particles within the plating solution, which may be as defined herein. High shear may be defined as subjecting the plating solution to turbulent flow. The plating solution may be agitated in the container in which the plating is carried out or in a separate unit, which may be termed an agitation unit herein. The plating solution may be agitated by a method selected from stirring the plating solution, shaking the plating solution, subjecting the plating solution to ultrasound, and any other suitable method. In an embodiment, the plating solution may be agitated by passing the plating solution through a centrifugal pump. In an embodiment, the plating solution is agitated by rotating an impeller in the plating solution, and preferably wherein the impeller has at least one blade that has, preferably a plurality of blades and each of which has, a surface that is substantially at a right angle to the plane that is at a right angle to the axis of rotation of the blade. In other words, the impeller may have an axis of rotation, and a plane can be defined such that the axis of rotation is perpendicular to the plane, and the impeller has one or more blades that has a surface that is substantially at a right angle to said plane. Such impellers may sometimes be referred to as high shear impellers, since the blades of the impeller effect turbulent, rather than laminar, flow of a liquid. The one or more blades of the impeller may extend radially from the axis of the impeller, or extend from a sheet that lies in the plane to which the axis of rotation is perpendicular. "Substantially at a right angle" may indicate an angle of from 70° to 110°, optionally from 80° to 100°, optionally from 85° to 95°, optionally about 90°. In an embodiment, the plating solution is agitated by rotating an impeller, which may be a high shear impeller, in the plating solution with a tip speed of at least 1 m/S, optionally a tip speed of at least 3 m/s, preferably a tip speed of at least 5 m/s. The impeller, which may be a high shear impeller and/or an impeller of the centrifugal pump, may rotate with a tip speed of from 5 m/s to 50 m/s, optionally a tip speed of from 5 m/s to 40 m/s, optionally a tip speed of from 5 m/s to 40 m/s, optionally a tip speed of from 5 to 25 m/s. In an embodiment, the impeller, e.g. the high shear impeller, is located within the container in which the articles are plated. In an embodiment, the impeller, e.g. the high shear impeller, is located in a separate container from the one in which the articles are plated, i.e. the agitation unit.

In an embodiment, the plating solution is agitated by passing the plating solution through a homogenizer, preferably a high pressure homogenizer. The homogenizer may be one that effects turbulent high velocity flow, which subjects the plating solution to high shear. A high pressure homogenizer may involve passing the plating solution along a conduit under pressure until a point at which the flow is diverted at an angle of approximately 90°.

In an embodiment, plating is carried out while the articles are within a receptacle that is placed within the container of plating solution (this container being termed a plating container herein for brevity), and the plating solution, before and/or during the plating is diverted from the container of plating solution to an agitation unit, in which the plating solution is agitated, and then returned to the plating container, and optionally the diverting of the plating solution to the agitation unit and return of the plating to the receptacle in which the articles are being plating is continuous, e.g. occurs during the entire plating of the metallic layer on the articles. In an embodiment, the plating is carried out while the articles are within a receptacle that is placed within the container of plating solution, and the plating solution, before and/or during the plating is circulated from the container of plating solution to an agitation unit, in which the plating solution is agitated, and then returned to the container of plating solution.

In an embodiment, plating is carried out while the articles are within a receptacle that is placed within the container of plating solution, and the plating solution, during the plating, which may be for part or all of the plating to form the metallic layer, is diverted, e.g. along a conduit such as a pipe, e.g. by being pumped, from the container of plating solution to an agitation unit in which the plating solution is agitated, and then returned to the plating container and optionally the diverting of the plating solution to the agitation unit and return to the receptacle in which the articles are being plating is continuous. This can be even more effective than subjecting the plating solution to ultrasound, since more of the luminescent particles from the plating solution can incorporated into the metallic layer on the articles. The agitation unit may comprise a means selected from an impeller, e.g. a high shear impeller, a centrifugal pump, an ultrasound unit for subjecting the plating solution to ultrasound, a homogeniser (which may use high pressure to cause turbulent flow), a static mixer, and any other means for subjecting the plating solution to turbulent flow. A static mixer is one in which a liquid is caused to flow past a series of static baffles, the flow past the static baffles inducing turbulent flow in the liquid. The agitation unit may comprise a centrifugal pump, which may be as described below.

The agitation may involve a method selected from stirring, shaking, subjecting the plating solution to ultrasound, and any other suitable method, e.g. any other method that subjects the plating solution to turbulent flow.

In an embodiment, plating is carried out while the articles are within a receptacle that is placed within the container of plating solution, and the plating solution, before and/or during the plating is diverted from the container of plating solution to a centrifugal pump, and then returned to the plating container, and optionally the diverting of the plating solution to the centrifugal pump and return of the plating to the receptacle in which the articles are being plating is continuous.

A centrifugal pump can be a pump in which liquid (e.g. the plating solution in the present application) is passed along a conduit, which may be along the direction of the axis of a rotating impeller, until it reaches a rotating impeller, the impeller then directing the liquid radially outward. After the liquid is directed radially outward, the liquid may be directed along a conduit to a desired location, e.g. back to the container in which the articles are being plated.

The centrifugal pump may comprise a rotating impeller that rotates about an axis, causing the plating solution to be directed radially outward and, optionally, a stator, through which the plating solution flows as it is directed radially outward. If a centrifugal pump has a rotating impeller and a stator, this may be termed a 'rotor stator' herein. A stator remains substantially stationary while the impeller is rotating. The stator may be an annular body having a plurality of apertures through which the plating solution flows as it is directed radially outward. In an embodiment, the impeller comprises an annular body having a plurality of apertures spaced circumferentially around the annular body. In an embodiment, the impeller comprises an annular body having a plurality of apertures spaced circumferentially around the annular body, and the apertures are defined by walls that are optionally at an angle that is offset from an angle that is radially outward from the axis of the impeller. In an embodiment, the stator comprises an annular body having a plurality of apertures spaced circumferentially around the annular body, and the apertures are defined by walls that are optionally at an angle offset from an angle that is radially outward from the axis of the impeller.

In an embodiment, the impeller has a plurality of annular bodies arranged concentrically, and each annular body may have a plurality of apertures spaced circumferentially around the annular body, and, optionally, the stator has an annular body having a plurality of apertures spaced circumferentially around the annular body and which is arranged between at least two of the concentrically arranged annular bodies of the impeller.

In an embodiment, the stator has a plurality of annular bodies arranged concentrically, each annular body having a plurality of apertures spaced circumferentially around the annular body, and, optionally, the impeller has an annular body having a plurality of apertures spaced circumferentially around the annular body and which is arranged between at least two of the concentrically arranged annular bodies of the stator.

In an embodiment, the stator and impeller each has a plurality of annular bodies arranged concentrically, each annular body having a plurality of apertures spaced circumferentially around the annular body, the annular bodies of the stator and impeller interlocking such that there is an alternate arrangement concentrically of stator annular bodies and impeller annular bodies. In such an arrangement, the plating solution would pass radially alternately through the apertures of the stator and the impeller.

In an embodiment, the centrifugal pump does not have a stator.

The impeller of the centrifugal pump may rotate with a tip speed of at least 1 m/S, optionally a tip speed of at least 3 m/s, preferably a tip speed of at least 5 m/s. The impeller of the centrifugal pump may rotate with a tip speed of from 5 m/s to 50 m/s, optionally a tip speed of from 5 m/s to 40 m/s, optionally a tip speed of from 5 m/s to 40 m/s, optionally a tip speed of from 5 m/s to 25 m/s. Tip speed of an impeller can be defined as the peripheral speed, in m/s, of the part of the impeller located furthest, radially, from the axis of rotation of the impeller. Tip speed=the angular velocity (in revolutions per second)×diameter of the impeller×π. It has been found that when using an impeller having a tip speed within the ranges stated above, a suitable balance between high shear forces and flow rate can be found, such that high volumes of plating solution can be passed through the centrifugal pump, while still subjecting the plating solution to a reasonable amount of shear. This has been found to promote inclusion of a reasonably high amount of luminescent particles in the metallic layer.

In an embodiment, the container in which the plating is carried out, can contain or contains a volume, $V_1$, of plating solution, and the plating solution, before and/or during the plating, is circulated from the container of plating solution to an agitation unit, which may be a centrifugal pump, in which the plating solution is agitated, and then returned to the container of plating solution, and the volume of liquid $V_2$ passed through the agitation unit, per hour is $n \times V_1$, wherein n is at least 1, optionally at least 3, optionally at least 5, optionally at least 10, optionally at least 15. Optionally, n is from 3 to 25, optionally from 5 to 25. In an embodiment, the impeller of the centrifugal pump rotates with a tip speed of at least 5 m/s, optionally at least 10 m/s, optionally at least 15 m/s, optionally from 15 m/s to 30 m/s, optionally from 15 m/s to 25 m/s and n is at least 10, optionally at least 15, optionally from 10 to 25, optionally from 15 to 20. Optionally, the impeller of the centrifugal pump rotates with a tip speed of from 15 m/s to 30 m/s and n is from 10 to 25, optionally from 15 to 20.

The container in which the plating of the articles is carrier out may contain at least 1 L of plating solution, optionally at least 5 L of plating solution optionally at least 10 L of plating solution, optionally at least 15 L of plating solution, optionally at least 20 L of plating solution, optionally at least 30 L of plating solution, optionally at least 50 L or plating solution, optionally at least 100 L of plating solution, optionally at least 200 L of plating solution, optionally at least 250 L of plating solution, optionally at least 300 L of plating solution. It has been found that ultrasound techniques, as described herein, are particularly effective when the volume of plating solution is up to about 20 L. However, when the volume of plating solution is more than 20 L, while ultrasound techniques still work, they become less efficient and can be more costly. It was a challenge therefore to devise a technique that would allow the same or similar efficacy as ultrasound, while being more energy efficient than ultrasound and not adversely affecting the plating of the metallic layer and deposition of the luminescent particles. The circulation of the plating solution to the agitation unit, as described herein, was found to provide a suitable alternative to ultrasound, and can be used at all volumes of plating solution, including high volumes, e.g. of at least 100 L, e.g. at least 300 L.

The plating may be carried out while the articles are within a receptacle that is placed within the container of plating solution, and the plating solution diverted, or circulated, to an agitation unit and then returned to the container of the plating solution (in which the plating is carrier out), and optionally, the receptacle moves within the plating solution. The receptacle may act to tumble the articles within the receptacle during the plating. In embodiments, the receptacle rotates within the plating solution. Such a receptacle may be in the form of a barrel. This may be termed barrel plating. The articles may be free to move within the receptacle (e.g., barrel) such that when the receptacle rotates, the articles move (e.g., rotate and/or tumble) within the receptacle relative to one another. This has been found to provide a relatively consistent plate thickness on all sides of the articles.

In an embodiment, plating is carried out while the articles are within a receptacle that is placed within the container of plating solution, and the plating solution, either before or during the plating is diverted, e.g. circulated, from the receptacle to an agitation unit, e.g, a centrifugal pump, in which the plating solution is agitated, and then returned to the plating container, and the receptacle moves, e.g. rotates, within the plating solution, preferably moves, e.g. rotates, continuously (optionally rotating at a constant speed) within the plating solution throughout the entire duration of the plating. The receptacle (e.g., barrel) may rotate at a speed of 1 to 50 rpm, optionally from 4 to 30 rpm, optionally from 4 to 15 rpm, optionally from 4 to 12 rpm, optionally from 6 to 10 rpm, optionally about 8 rpm. The rate of rotation may be varied during plating or be held constant, for example for the entire duration of the plating. The articles may be free to move within the receptacle (e.g., barrel) such that when the receptacle rotates, the articles move (e.g., rotate and/or tumble) within the receptacle relative to one another.

In an aspect, there is provided an apparatus, which may be for carrying out the method of any of the aspects described herein. In an embodiment, the apparatus comprises:

a container for holding a plating solution, a means, e.g. a receptacle, for holding a plurality of articles within the plating solution, and, optionally, a means for agitating the plating solution before and/or during the plating.

The container for holding a plating solution may be termed a plating container herein for brevity. The apparatus may comprise a means for applying an electrical potential to the articles when they are within the container of the plating solution, e.g. such that electroplating may be carried out.

The means, e.g. receptacle, for holding a plurality of articles within the plating solution may be configured to move continuously during the plating process. The means, e.g. receptacle, for holding a plurality of articles may be configured to rotate on an axis that is substantially horizontal. The means, e.g. receptacle, for holding a plurality of articles may be configured to move (e.g., rotate) at a constant rate during the plating. Optionally, the receptacle is or comprises a barrel and the apparatus is adapted such that the articles are continuously rotated in a barrel, and optionally at a constant rate, during the plating of the plurality of articles. Optionally, the rotation of the barrel is periodically interrupted. The receptacle (e.g., barrel) may rotate at a speed of 1 to 50 rpm, optionally from 4 to 30 rpm, optionally from 4 to 15 rpm, optionally from 4 to 12 rpm, optionally from 6 to 10 rpm, optionally about 8 rpm. The rate of rotation may be varied during plating or be held constant, for example for the entire duration of the plating.

The means for agitating the plating solution may be a means for subjecting the plating solution to an ultrasound treatment, and the apparatus may be adapted to apply the ultrasound to the plating solution as described herein, e.g. before and/or during the plating of the articles.

In an embodiment, the apparatus comprises a means for agitating the plating solution, and the means may be adapted to agitate the plating solution as described herein, e.g. adapted such that the plating solution is agitated before and/or during the formation of the metallic layer (i.e., plating process). In an embodiment, the means for agitating the plating solution may be within the container for holding the plating solution in which the articles are plated. In an embodiment, the means for agitating the plating solution is located in an agitation unit, that is separate from the container for holding the plating solution in which the articles are plated, and the apparatus may be adapted to divert, e.g. circulate, the plating solution from the container for holding the plating solution in which the articles are plated to the agitation unit, in which the plating solution is agitated, and then returned to the container for holding the plating solution in which the articles are plated (which may be termed a plating container herein, for brevity). The means for agitating the plating solution may comprise an impeller, which may be adapted to operate as described herein. The means for agitating the plating solution may comprise a centrifugal pump, which may be adapted to operate as described herein.

"Adapted such that" and other similar phrases may indicate that the apparatus is able to perform a particular operation, and, in embodiment, is programmed to perform a particular operation.

In an aspect, there is provided an apparatus, which may be for carrying out the method of any of the aspects described herein, the apparatus comprising:

a container for holding a plating solution, a receptacle for holding a plurality of articles within the plating solution, and, a means for agitating the plating solution before and/or during the plating wherein the receptacle for holding a plurality of articles within the plating solution is configured to move continuously during the plating process, wherein the means for agitating the plating solution before and/or during the plating, is a means for subjecting the plating solution to an ultrasound treatment, and/or the means for agitating the plating solution is located an agitation unit, that is separate from the container for holding the plating solution in which the articles are plated, and the apparatus is adapted to divert, e.g. circulate, the plating solution from the container for holding the plating solution in which the articles are plated to the agitation unit, in which the plating solution is agitated, e.g. before and/or during plating of the articles, and then return the plating solution to the container for holding the plating solution in which the articles are plated. The means for agitating the plating solution in the agitation unit may comprise an impeller, which may be adapted to operate as described herein. The means for agitating the plating solution in the agitation unit may comprise a centrifugal pump, which may be adapted to operate as described herein.

As described herein, embodiments of the present invention provide a plating solution comprising a liquid medium, a precursor species for forming a metallic layer during a plating process, and a plurality of luminescent particles suspended in the liquid medium, at least some of which have diameters of 10 μm or less. The liquid medium, a precursor species, metallic layer, plating process, and luminescent particles may be as described herein.

In embodiments, at least some of the luminescent particles in the plating solution have diameters of 5 μm or less. In embodiments, at least some of the luminescent particles in the plating solution have diameters of 0.5 μm to 1 μm.

In embodiments, in the plating solution, the precursor species are for forming the metallic layer during a plating process, wherein the metallic layer may comprise a metal selected from zinc, copper, tin, nickel, and alloys of one or more thereof.

Articles plated in accordance with some embodiments of the present invention have a homogenous distribution (this may also be referred to herein as a uniform or statistically random distribution, or spatial homogeneity) of luminescent particles throughout the metallic layer. Embodiments of the present invention may produce plated articles with a homogenous distribution by utilizing a combination of a particular particle size range of luminescent particles (e.g., particles having a diameter of from 0.5 μm to 1 μm) and constant motion of the articles (e.g., in a receptacle that rotates continuously) during the plating process. As is further discussed herein, the level of luminescent signal emitted from the luminescent particles co-deposited into the plated metal layer may be proportional to the volume percent of luminescent particles incorporated into the plated layer. As is also discussed hereinafter, to achieve at least a good quality finish of the plated layer and a constant signal throughout the lifetime of utilization of the plated article, these luminescent particles have a homogenous distribution in the plated layer. As a corollary, a plated article with a homogenous distribution of luminescent particles in the plated metal layer will typically produce a more consistent luminescent signal as the plated article wears in use over time (e.g., a coin in public circulation).

Figure 9:
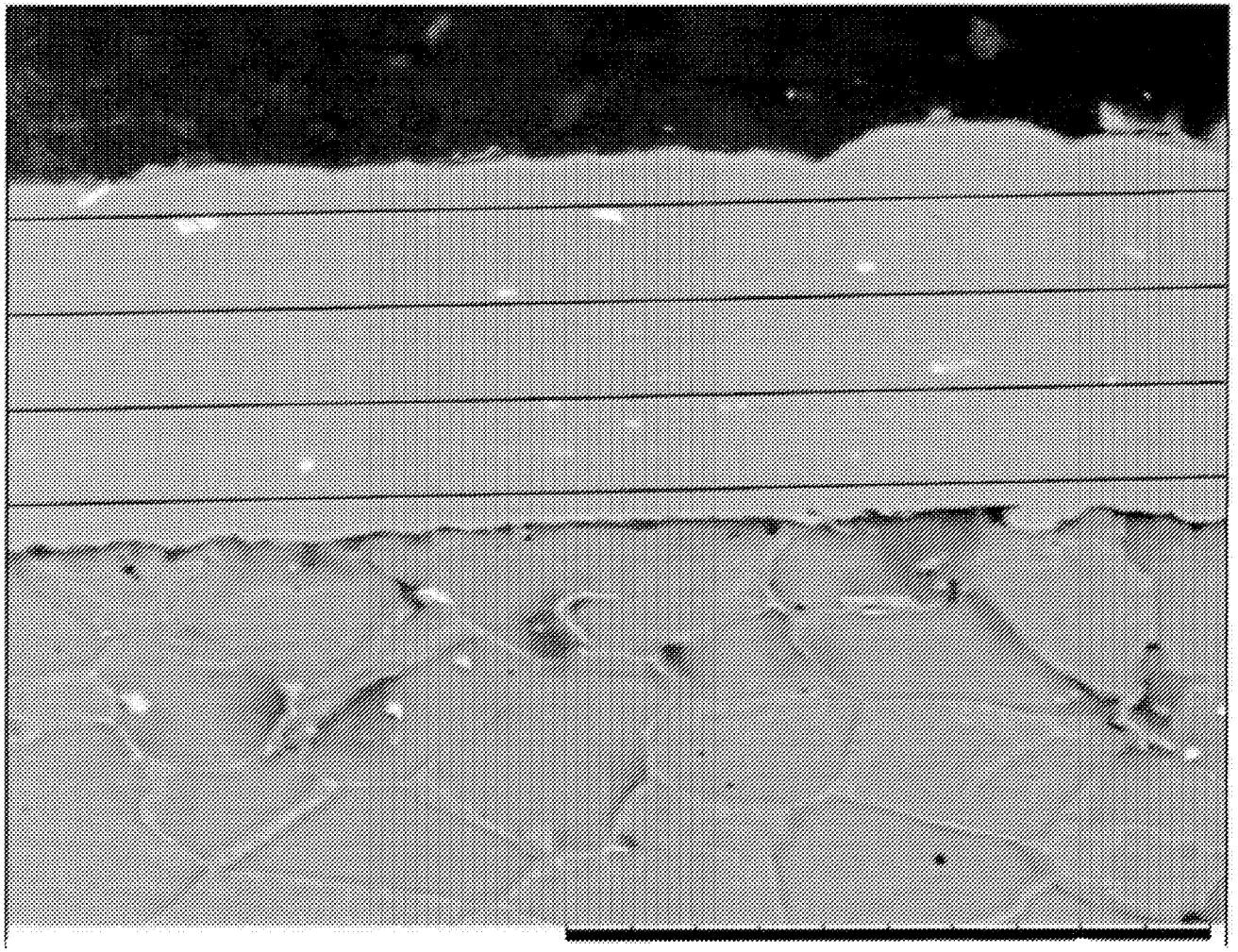
FIG. 9 shows a scanning electron micrograph image of a cross-section of an exemplary electroplated article exhibiting a homogenous, or uniform, distribution of luminescent particles incorporated into the plated layer.
Figure 10:
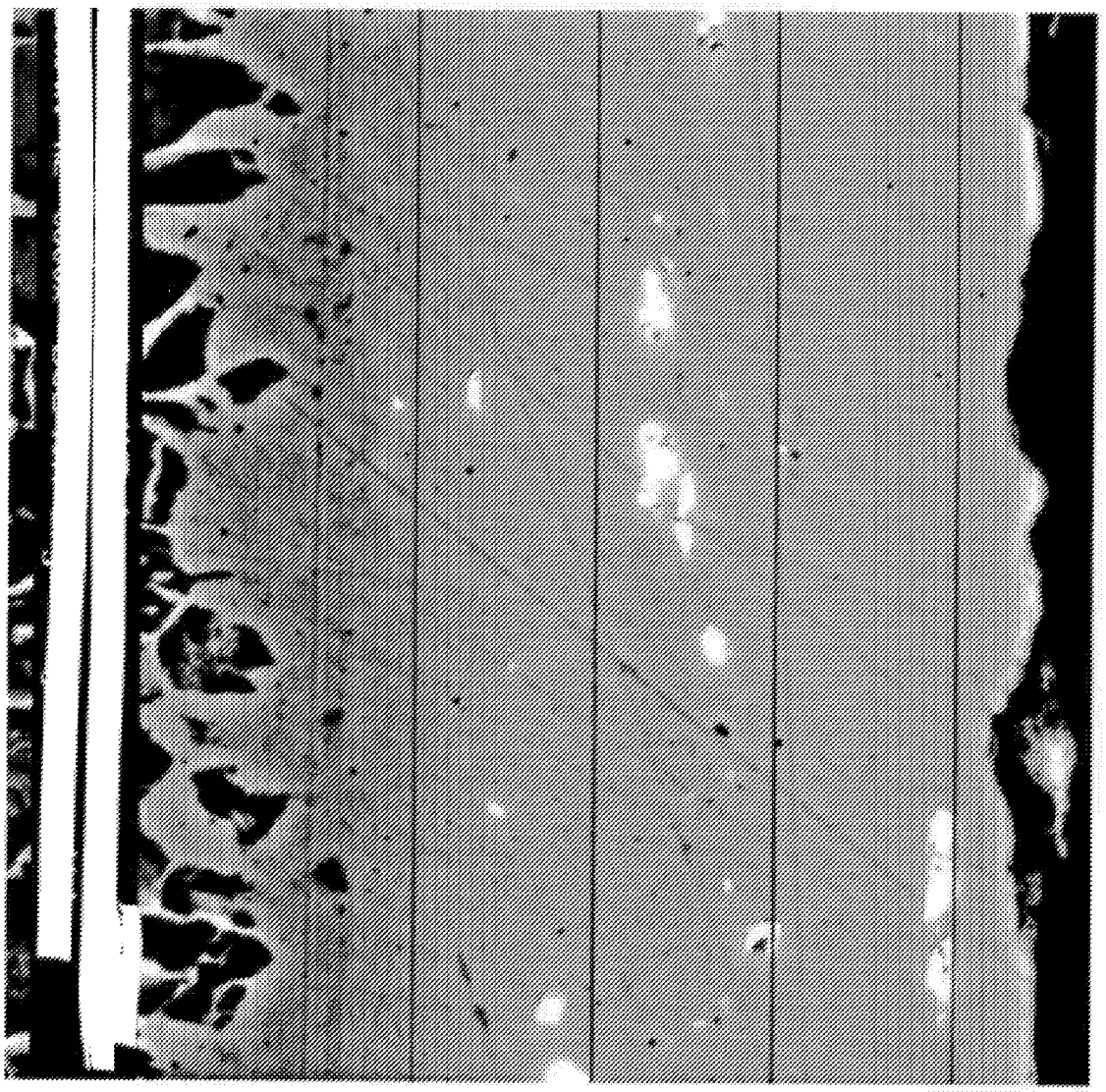
FIG. 10 shows a scanning electron micrograph image of a cross-section of an exemplary electroplated article exhibiting a non-homogenous, or non-uniform, distribution of luminescent particles incorporated into the plated layer.

A homogenous distribution of the luminescent particles co-deposited within the plated metal layer may be determined using a variety of methods. Robust statistical methods to determine the levels of spatial homogeneity are readily available, for example, nearest neighbor methods and Ripley's k-function. Referring to FIGS. 9-10, another method for determining whether an article plated in accordance with embodiments of the present invention has a homogenous distribution of co-deposited luminescent particles is to separate a cross-section of the plated article into three relatively equidistant layers. In FIGS. 9-10, these equidistant layers are indicated by the four horizontal black lines across the images of the exemplary plated samples. Comparison of the approximate percentages of the plated layer occupied by luminescent particles (the light spots) in each layer provides an estimate of the homogeneity. Analysis of the percentage in each layer may be determined using image processing software, such as the GNU® Image Manipulation Program or Adobe® Photoshop. FIG. 9 shows a digital image of a cross-section of an article plated with a metal layer co-deposited with luminescent particles in accordance with embodiments of the present invention, wherein it can be readily observed that there is a homogenous distribution of the luminescent particles throughout the plated metal layer. In contrast, FIG. 10 shows a digital image of a cross-section of an article plated with a metal layer co-deposited with luminescent particles, wherein it can be readily observed that there is not a homogenous distribution of the luminescent particles throughout the plated metal layer.

As described herein, embodiments of the present invention provide an article having an electroplated metallic layer thereon, wherein luminescent particles are dispersed in the electroplated layer, wherein at least some of luminescent particles have a diameter of 10 μm or less and the distribution of the luminescent particles in the plated metal layer is homogenous (except for the initial luminescent particle-free layer). The article may be producible in accordance with methods described herein. The article, the metallic layer, and the luminescent particles may be as described herein.

Figure 3:
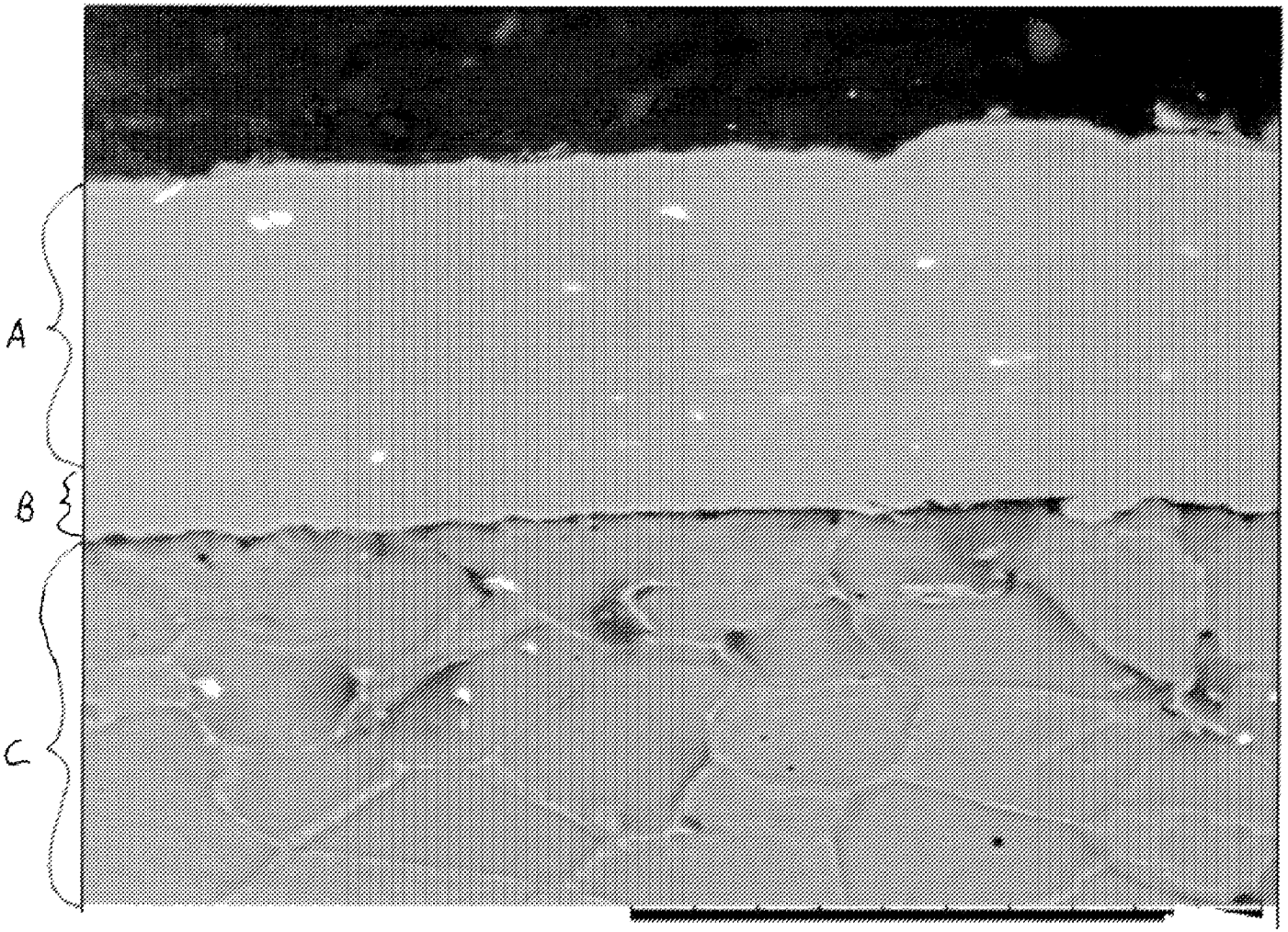
FIG. 3 shows a scanning electron micrograph ("SEM") image of a cross-section of an article plated in accordance with embodiments of the present invention.

Referring to FIG. 3 as an example, embodiments of the present invention provide an article (layer C) having an electroplated metallic layer (layers A and B) thereon, where luminescent particles are dispersed in the electroplated layer in a first portion (layer A) of the electroplated layer, and a second portion (layer B) of the electroplated layer substantially absent of luminescent particles (the initial luminescent particle-free layer) is disposed between the first portion (layer A) and the article (layer C), wherein the depth of the second portion (layer B) may be less than 4 μm. The plated article may be producible in accordance with methods described herein. The article, the metallic layer, and the luminescent particles may be as described herein. In embodiments, the article may be in the form of a disc. In embodiments, the article may be in the form of a disc having a three-dimensional pattern stamped thereon after formation of the plated metallic layer. In embodiments, the article may comprise steel, and the metallic layer may comprise a metal selected from zinc, copper, tin, nickel, and an alloy selected from one or more thereof.

Embodiments of the present invention will now be further described with reference to the following non-limiting Examples (also referred to herein as "experiments," "trial runs," "trials," and "runs") and accompanying Figures.

EXAMPLES

Example 1

Figure 11:
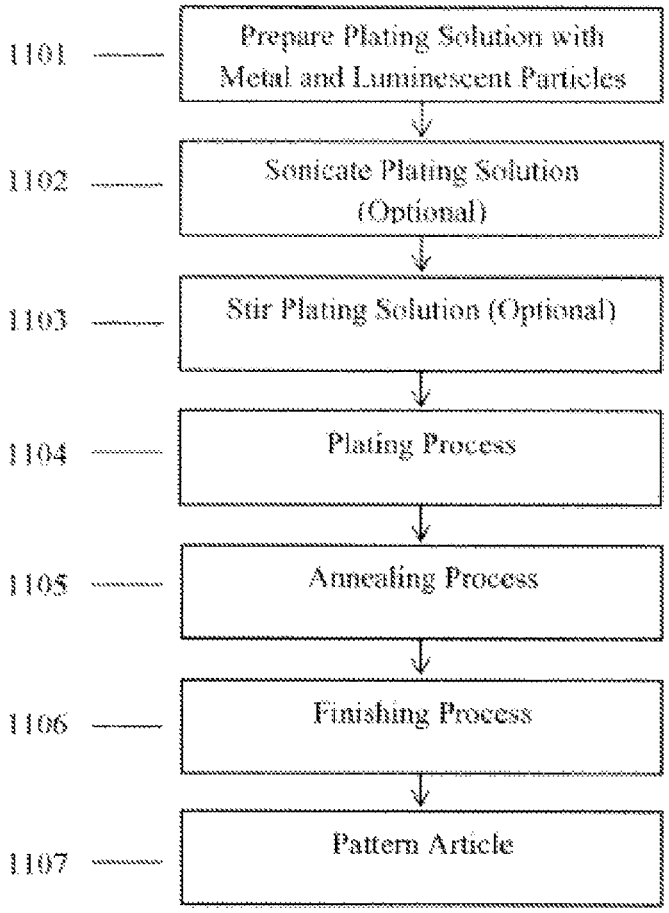
FIG. 11 shows a flow diagram of steps configured in accordance with embodiments of the present invention.

The following non-limiting Examples may utilize variations of the plating steps illustrated in FIG. 11. As has already been discussed, and as will be further described hereinafter, a plating solution is prepared in step 1101 with inclusion of the metal particles to be plated and the accompanying luminescent particles. Sonication of the plating solution may be performed in step 1102 in various implementations described herein. The plating solution may also be stirred, or agitated, in step 1103 in various implementations described herein. The plating process is performed in step 1104 in various implementations described herein. And, if required for the final plated article, the plated article may be patterned (e.g., mechanically stamped or striked) in step 1105, wherein the plated layer is also subjected to such patterning.

Luminescent particles having a D90 distribution of approximately 10.636 microns and a mean particle size of approximately 8.95 microns were dosed into Nickel Sulphamate at approximately 15 g/l and agitated, stirred, and sonicated for approximately 6 hours; the solution was then left to settle. After 1 hour, the top 50% of solution was decanted into a separate vessel. This top solution was then passed through several paper cartridge filters to reduce the mean particle size. This final filtrate was then evaporated and the remaining concentrate dosed into Nickel Sulphamate to electroplate articles (e.g., coinage) with luminescent particles of a reduced size. This particle size was verified by SEM analysis of the plated articles.

The luminescent particles were a doped lanthanide oxysulfide. A matrix of experiments was designed and carried out (also referred to herein as "trials," "trial runs," or "plating runs" or similar terminology) firstly using a Nickel Sulphamate based plating solution, Copper (cyanide), and then direct Brass (cyanide) plating solutions.

The steel metal articles (e.g., coin blanks) were weighed and then transferred to a plating barrel. Before this, they may be cleaned in an alkaline cleaner at approximately 60° C. to remove any cutting oil, which may have remained. The steel articles (which may be mild steel) then may be rinsed in demineralised water also at approximately 60° C. and then acid etched (e.g., using a 120 g/l solution of sulphuric acid at 50° C.). The steel articles were then transferred to the plating bath and an electrical current applied. The plating barrel continually rotated with no interruption to the current or rotation during the entire plating operation.

After the plating cycle was complete, the plated articles were removed from the plating solution and again rinsed in hot demineralised water. They were then dried (e.g., transferred to a lab tray and placed in a hot air drier until dry). They were then annealed (e.g., heated in a controlled atmosphere) to soften the base metal and plated layer, producing an oxide layer on the surface of the plated article. This oxide layer may be removed during a finishing process (e.g., using an acid soap and stainless steel media in a rotary high energy finisher). The finished plated article, depending on a customer requirement, may be supplied finished as a blank (e.g., coin blank) or struck with a pattern (e.g., to produce coinage).

The plated articles, when cold, were re-weighed, and examined for plate thickness (e.g., using X-ray fluorescence ("XRF")). Signal strength (emitted electromagnetic energy) from the luminescent particles co-deposited in the plated layer was measured (e.g., with an appropriate signal measuring device capable of measuring electromagnetic energy, or at least relative signal strengths emitted from each article). The plated articles were then further processed and struck with a pattern. The luminescent signal strength was measured at each such stage, and the plated articles were cut into cross-sections and examined (e.g., under a scanning electron microscope ("SEM")).

From analysis of the results of the experiments, optimum conditions, parameters, and variables were derived. A series of confirmation plating runs were carried out to confirm the findings. Further details on the experiments carried out, and the results, are provided below.

FIG. 1 illustrates schematically an apparatus 100 that may be used for carrying out the plating process in accordance with embodiments of the present invention, which may utilize the following list of commercially available items. Embodiments of the present invention are not limited to this specific configuration. The apparatus 100 includes a receptacle 101 for retaining the plating solution, a tumbler (e.g., rotary) 102 for tumbling the articles within the plating solution during the plating process, an electrode 103 that acts as a cathode during the plating process, this electrode extending into the barrel of the rotary tumbler, a power source 104, a further electrode 105 (e.g., in the form of a basket), which acts as an anode during the plating process, a temperature transmitter ("TT") device 106 for temperature measurement (e.g., a Pt100 sensor), which is linked via a connector 108 to a temperature controller ("TC") device 107, a stirrer 109, a pump 110 that circulates plating solution (e.g., around a conduit 111 and a valve 112, which may be a pneumatic valve).

Though the equipment and setup for carrying out the embodiments of the present invention are not limited to the following specifics, the experiments utilized the following apparatuses and setups:

Hotplate—Jenway 572 hotplate and stirrer.
Scales—Kern 572 precision balance.
Tumbler—Beach 2.25 kg Barrel Tumbler.
Pump—2×EHeim 300 l/hr, 600 l/hr.
Pump—Positive Displacement filter pump.
16 L Poly-propylene plating bath.
Stirrer—Stuart General Purpose Ss10.
Sonotrode—Heilscher UIP1000hd (for creating ultra-sound vibrations).
Electronic Stopwatch/Countdown Timer.
Plating rig/barrel—Schloetter.
Anode basket—Schloetter Grade 1 titanium 300×150×25 mm
Heater—Braude Thermomaster controller and 1 kW heater.
Rectifier—AE-PS 3016-10 B.
pH—Mettler Toledo seven easy pH meter.
XDC—Fischerscope X-ray system XDL.
Belt annealing furnace—Wellman.
Stainless steel finishing media (4 mm, in the form of balls).
Trial press or production coin press—Schuler.
Luminescent measurement device—an LED and filtered photodiode detector appropriately chosen for the particular luminescent material that is used
Scanning Electron Microscope ("SEM")—Phillips.

Though the materials and methods for carrying out the embodiments of the present invention are not limited to the following specifics, the experiments utilized the following materials and methods:

(a) Materials
Caustic based cleaner 5% vol.
Sulphuric Acid 120 g/L.
Luminescent particles.
Surfactants/Wetting Agents.
Plating Bath Solutions—See Table 1.
pH control chemicals—(e.g., sulphamic acid)
Acid soap.
Articles for plating (e.g., mild steel parts).

Exemplary chemical bath compositions for the plating baths (solutions) are reproduced in Table 1.

TABLE 1

| | SPECIFICATIONS | |
|---|---|---|
| | Low | High |
| Zinc Plating | | |
| ZINC g/l | 8 | 44 |
| EL/ETCH ACID g/l | 10 | 180 |
| TANK 13 Zn g/l | 0 | 32 |
| EL/CLEAN % | 1 | 20 |
| HYDROXIDE g/l | 65 | 370 |
| CARBONATE g/l | 40 | 440 |
| OC 1150 Conc. | 0 | 0.6 |
| Copper Plating | | |
| CYANIDE g/l | 2 | 5 |
| COPPER g/l | 15 | 180 |
| CARBONATE g/l | 12 | 200 |
| EL/ETCH ACID g/l | 55 | 400 |
| CLEANER 1 % | 2 | 20 |
| CLEANER 2 % | 2 | 20 |
| EL/CLEAN % | 2 | 20 |
| HYDROXIDE g/l | 4 | 32 |
| OC 1150 Conc. | 0 | 0.6 |
| Nickel Plating | | |
| TOTAL NICKEL g/l | 30 | 200 |
| NICKEL CHLORIDE g/l | 2 | 30 |
| BORIC ACID g/l | 12 | 70 |
| IRON ppm | 0 | 100 |
| pH | 2.5 | 6.5 |
| EL/ETCH ACID g/l | 55 | 400 |
| CLEANER 1 % | 2 | 20 |
| CLEANER 2 % | 2 | 20 |
| EL/CLEAN % | 2 | 20 |
| SULPHAMIC ACID g/l | 50 | 360 |

(b) Method (note that many of the following steps are optional), which essentially implements the process shown in FIG. 11.

(i) A standard plating bath or solution (e.g., 16 L) was prepared having one of the compositions indicated in Table 1.

(ii) A desired amount of luminescent particles (taggant), surfactants, and other additives were added to the plating bath (the taggant was present in an amount of approximately 3 to 6 g/L).

(iii) The articles were weighed and counted. A typical load for the plating barrel was between 150-450 g of articles.

(iv) The sonotrode was set to the required amplitude and timed for pre-sonication of the plating bath.

(v) Cutting oil was removed from the articles with a caustic-based cleaner. The cleaner was heated to approximately 60° C. The articles and cleaner were and loaded into a receptacle. The receptacle was loaded into an offline tumbler and rotated at a speed of approximately 10 rpm for 10 minutes.

(vi) The cleaner was removed from the articles with demineralised water.

(vii) The surfaces of the articles were activated with sulphuric acid. The acid was heated to approximately 50° C. The articles and the acid were and loaded into a receptacle. The receptacle was loaded into an offline tumbler and rotated at a speed of approximately 10 rpm for 5 minutes.

(viii) The acid was removed from the articles with demineralised water.

(ix) The articles were loaded into the plating barrel, attached to the plating rig and submerged in the electrolyte (plating bath).

(x) The sonotrode was set to the required amplitude for plating.

(xi) The required current was set by manipulation of the rectifier current output and a resulting voltage was applied across the articles.

(xii) A number of standard analytical methods were performed to ensure that respective solute concentrations in the electrolyte (plating bath) were within the desired specification limits (e.g., see Table 2).

(xiii) pH was measured with the Mettler Toledo pH probe and controlled with chemical additions specific to the plating bath chemistry.

(xiv) After the required residence time was reached, the current was stopped, and the plating barrel removed from the rig and rinsed in demineralised water.

(xv) The rinsed plated articles were towel dried, placed onto a metal tray and dried at approximately 120° C. until all water was removed.

(xvi) The plated articles were allowed to cool and then re-weighed to determine the change in mass.

(xvii) Plate thicknesses were determined by the XRF from a sample of 25 plated articles.

(xviii) Luminescent signal amplitude was determined using the measurement device from a sample of the 25 plated articles.

(xix) Three quarters of the plated articles were annealed using a Belt Furnace with a reducing atmosphere and a maximum furnace temperature of approximately 850° C.

(xx) Luminescent signal amplitude was determined on a sample of the 25 annealed and plated articles using the measurement device; the signal results were again recorded on the lab data sheet.

(xxi) Two thirds of the annealed and plated articles were loaded into a receptacle with a 1:1 mass ratio of stainless steel media.

(xxii) Additions of approximately 25 ml of demineralised water and approximately 0.5 ml of acid soap was added to the receptacle which was run for approximately 15 minutes at 10 rpm in the tumbler to simulate a finishing procedure on surfaces of the annealed and plated articles.

(xxiii) Luminescent signal amplitude was again determined using the measurement device from a sample of the finished articles.

(xxiv) Some of the finished articles were pressed with a pattern either on the production or trial Schuler press to strike a coin.

(xxv) Luminescent signal amplitudes were measured from a sample of the struck coins using the measurement device.

Table 2 indicates the conditions for the plating processes in certain trial runs carried out.

TABLE 2

| | Run Reference No. | | | |
|---|---|---|---|---|
| | 1 | 16 | 17 | |
| Plate Type | Nickel | Nickel | Nickel | |
| | Metal Disc Data | | | |
| Diameter | 17.59 | 17.59 | 17.59 | mm |
| Gauge | 1.16 | 1.16 | 1.16 | mm |
| Average Initial Weight per part | 3.15 | 3.15 | 3.15 | grams |
| Initial Mass | 173.99 | 310.93 | 310.77 | grams |
| Parts Plated | 55 | 100 | 100 | pieces |
| | Pre Plating Data | | | |
| Alkaline Cleaning Time | 10 | 10 | 10 | minutes |
| Cleaner Temperature | 60 | 60 | 60 | ° C. |
| Cleaner Concentration | 7.5 | 7.2 | 7.5 | % |
| Cleaner Type | Alkaline based | Alkaline based | Alkaline based | |
| Rotation Speed | 10 | 10 | 10 | rpm |
| Acid Type | $H_2SO_4$ | $H_2SO_4$ | $H_2SO_4$ | |
| Acid Cleaning Time | 5 | 5 | 5 | minutes |
| Acid Temperature | 50 | 50 | 50 | ° C. |
| Acid Concentration | 120 | 120 | 120 | g/l |
| Mill Rotation Speed | 10 | 10 | 10 | rpm |
| Initial Sonication Before Run | 0 | 0.5 | 0.5 | hrs |
| | Bath Chemistry | | | |
| Nickel titre - EDTA Volume | 34.3 | 26.1 | 26.4 | ml |
| Chloride titre - $AgNO_3$ Volume | 1.4 | 4.6 | 1.325 | ml |
| Boric Acid titre - NaOH Volume | 5.5 | 1.25 | 4.45 | ml |
| pH | 4.2 | 4 | 4.2 | $\log_{10}$(l/mol) |
| Electrolyte Density | 1.3 | 1.3 | 1.3 | $kg/dm^3$ |
| Taggant Density | 8 | 8 | 8 | $kg/dm^3$ |
| Wetting Agent/Surfactant | none | none | none | |
| | Bath Specifications | | | |
| Anode Basket Material | Class 1 titanium | Class 1 titanium | Class 1 titanium | |
| Anode Material | Sulphur Depolarised Ni Shot | Sulphur Depolarised Ni Shot | Sulphur Depolarised Ni Shot | |
| Anode Bag Material | woven PP | woven PP | woven PP | |
| Filter Type | Cartridge | Cartridge | Cartridge | |
| Filter Size | 1 | 1 | 1 | μm |
| Filter Material | PP | PP | PP | |
| Heater Size | 1000 | 1000 | 1000 | Watts |
| Evaporation Rate | 1 | 1 | 1 | $dm^3/hr$ |
| Bomb Diameter | 8 | 8 | 8 | mm |
| Bomb Material | Copper | Copper | Copper | |

TABLE 2-continued

| | Run Reference No. | | | |
|---|---|---|---|---|
| | 1 | 16 | 17 | |
| Dangler Length | 50 | 50 | 50 | mm |
| Barrel Diameter | 70 | 70 | 70 | mm |
| Barrel Length | 100 | 100 | 100 | mm |
| Barrel Pore Size | 0.5 | 0.5 | 0.5 | mm |
| Bath Volume | 18 | 18 | 18 | $dm^3$ |
| Filter Size | 1 | 1 | 1 | μm |
| | Plating Data | | | |
| Ultrasound Power | 2000 | 2000 | 2000 | Watts |
| Plating Time | 3 | 6 | 6 | hours |
| Current Density | Std R.M. | Std R.M. | Std R.M. | $A/dm^2$ |
| Ultrasonic Frequency | 20 | 20 | 20 | kHz |
| Temperature | 60 | 60 | 60 | ° C. |
| Barrel Rotation Speed | 8 | 8 | 8 | rpm |
| Sonication Amplitude | 0 | 50 | 50 | % |
| Sonication prior to Run | none | none | Yes | |
| Sonication first 30 mins of Run | none | Yes | Yes | |
| Sonication for remainder Run | none | Yes | none | |
| Stirrer | 1250 | 1250 | 1250 | rpm |
| Filter Pumps | 0 | 0 | 0 | l/hr |
| Recirculating Flowrate | 0 | 60 | 60 | l/hr |
| Final Mass | 177.25 | 322.26 | 323.26 | grams |

Results

A plurality of trial runs were carried out generally utilizing the foregoing method, each with varying factors, such as taggant (luminescent) particle size, the use of ultrasound before and/or during plating, electrochemical parameters such as current densities, and creating turbulence (e.g., stirring) in the plating solution. Each trial run was analysed after striking on a striking press (e.g., Schuler), luminescent signal measurements being taken before and after striking as a control. The luminescent signal strength was measured using a measurement device. Details of some of the runs are outlined in Table 3.

TABLE 3

| RUN REF. NO. | PARTICLE SIZE | US PRIOR TO PLATING | US ON FOR INITIAL 30 mins | US ON FOR REMAINDER OF RUN | SEDIMENTATION | VISUALLY ACCEPTABLE? | SIGNAL STRENGTH |
|---|---|---|---|---|---|---|---|
| 1 | Large | OFF | OFF | OFF | Total | NO | LOW |
| 2 | Large | OFF | OFF | OFF | Total | NO | LOW |
| 3 | Large | OFF | OFF | OFF | High | NO | LOW |
| 4 | Large | OFF | OFF | OFF | High | NO | LOW |
| 5 | Large | OFF | OFF | OFF | High | NO | LOW |
| 6 | Large | OFF | OFF | OFF | High | NO | LOW |
| 7 | Large | OFF | OFF | OFF | High | NO | LOW |
| 8 | Large | OFF | ON | ON | High | NO | LOW |
| 9 | Large | OFF | OFF | OFF | High | NO | LOW |
| 10 | Large | OFF | ON | ON | High | NO | LOW |
| 11 | Large | OFF | ON | ON | High | NO | LOW |
| 12 | Large | OFF | ON | ON | High | NO | LOW |
| 13 | Large | OFF | ON | ON | High | NO | LOW |
| 14 | Large | OFF | ON | ON | High | NO | LOW |
| 15 | Large | OFF | ON | ON | High | NO | LOW |
| 16 | Medium | OFF | ON | ON | High | YES | LOW |
| 17 | Medium | ON | ON | OFF | Low | YES | HIGHEST |
| 18 | Medium | ON | ON | OFF | Low | YES | HIGHEST |
| 19 | Small | ON | ON | ON | Low | YES | MEDIUM |
| 20 | Small | ON | ON | ON | Low | YES | MEDIUM |
| 21 | Small | ON | ON | OFF | Low | YES | MEDIUM |
| 22 | Small | OFF | OFF | ON | Low | YES | HIGH |
| 23 | Small | OFF | OFF | ON | Low | YES | HIGH |
| 24 | Small | OFF | OFF | ON | Low | YES | MEDIUM |
| 25 | Small | ON | ON | ON | Low | YES | MEDIUM |
| 26 | Small | ON | ON | ON | Low | YES | MEDIUM |
| 27 | Small | ON | OFF | OFF | Low | YES | HIGH |
| 28 | Small | ON | OFF | OFF | Low | YES | MEDIUM |
| 29 | Small | ON | OFF | OFF | Low | YES | MEDIUM |

Figure 5:
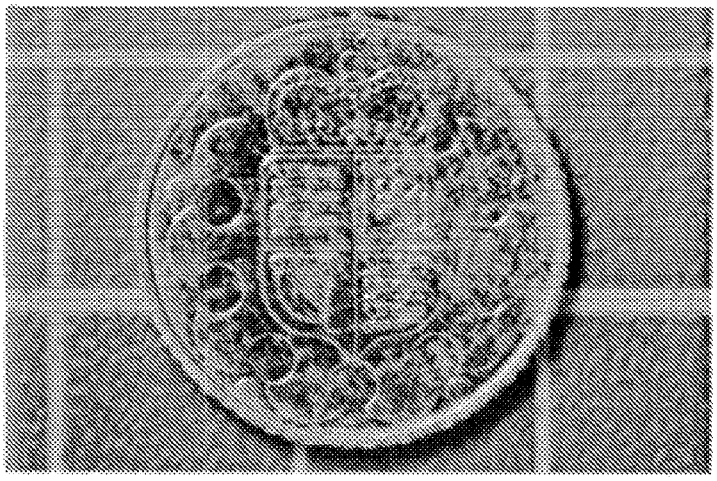
FIGS. 5-8 show digital images of electroplated and struck coins of varying quality of finish standards.
Figure 6:
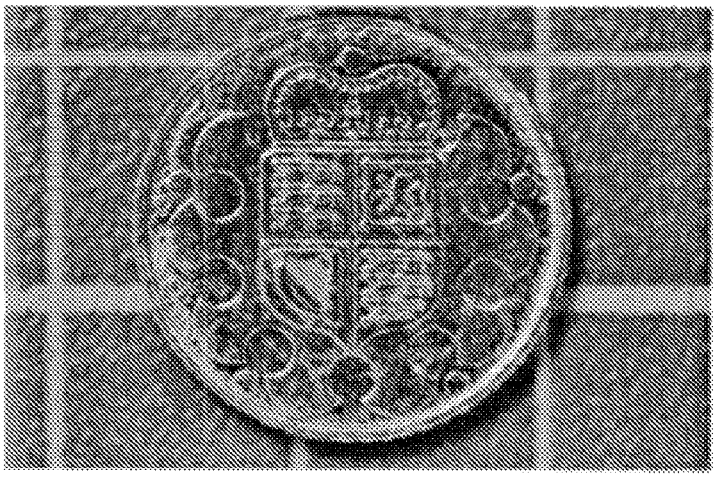
Figure 7:
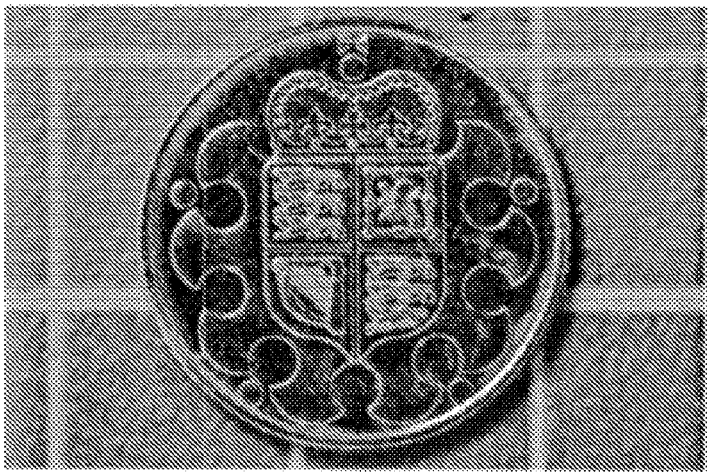
Figure 8:
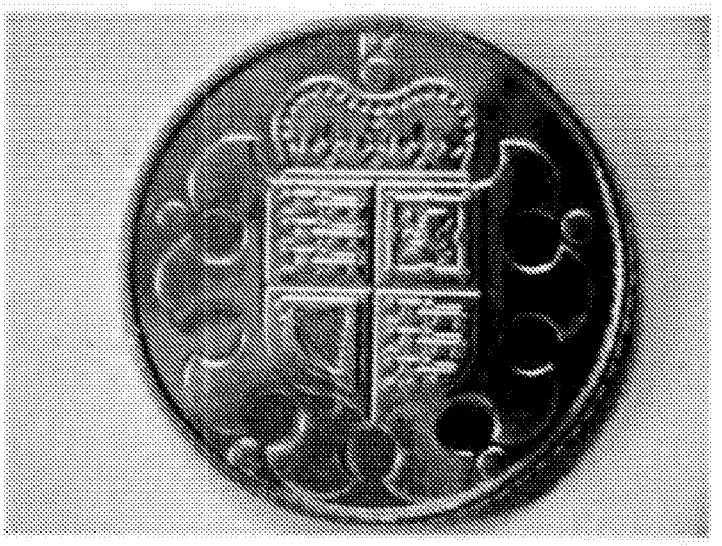

As has been discussed herein, the quality of the finish of the plated article can be a determining factor for which parameters and variables are to be implemented in embodiments of the present invention. The prior art has never determined what parameters and variables produce various finish qualities, whereas the inventors have done so. The Run Reference Nos. 1, 16, and 17 in Table 3 correspond to these Run Reference Nos. in Table 2. Table 3 provides examples of plated articles that had various finish qualities and luminescent signal strengths, and which parameters, variables, etc. produced such finish qualities. Quality of Finishes of plated articles were classified as "Very Poor," "Poor," "Good," and "Excellent" quality of finishes. For a comparison of these quality of finish determinations produced on plated articles, refer to FIGS. 5-8. FIG. 5 shows a digital image of a plated and patterned, or struck, coin having a very poor quality of finish (e.g., the design of the pattern is impaired, the finish has a matte finish, and there are large blemishes on the surface). FIG. 6 shows a digital image of a plated and patterned, or struck, coin having a poor quality of finish (e.g., the design of the pattern is impaired, the finish has a satin finish, and there are small blemishes on the surface). FIG. 7 shows a digital image of a plated and patterned, or struck, coin having a good quality of finish (e.g., the design of the pattern is clear, the finish has a shiny finish, and there are no blemishes on the surface). FIG. 8 shows a digital image of a plated and patterned, or struck, coin having an excellent quality of finish (e.g., the design of the pattern is perfect, the finish has a mirror-like finish, and there are no imperfections on the surface).

In Table 3, if a plated article had a Good or Excellent quality of finish, it was designated in the table as Visually Acceptable.

1. Discussion of Results a. Particle Size Distribution

From an analysis of the results, luminescent particle size can have an influence on a number of properties of the resultant plated article. Referring to FIG. 2, the highest luminescent signal measurement from each particle size distribution was plotted against signal strength. In this Figure, "particle size" on the x axis, and in the discussion below, indicates mean diameter, using SEM analysis. The y axis shows measured luminescent signal strength (e.g., using an LED and filtered photodiode signal detector appropriately chosen for the phosphor used in the experiments). The "Small," "Medium," and "Large" size designations in FIG. 2 are further described hereinafter. Note further that the Run number designations in FIG. 2 also correspond to the Run Reference Nos. in Tables 2 and 3. The mean particle sizes in FIG. 2 are in microns.

The results indicate that an increase in luminescent signal corresponds to an increase in the amount of particulate material (luminescent particles) co-deposited into an electroplated layer. Through SEM analysis of a variety of surfaces of the plated examples and the signal response of those surfaces, the highest particle populations also returned the largest signals.

b. Sonication of the Plating Solution During the Plating Process

It was found that, at higher luminescent particle sizes (approximately >1 μm), the application of sonication (ultrasound treatment) of the plating bath decreased the luminescent signal received by the signal detector. This implies that the amount of co-deposited luminescent particles decreases significantly with sonication during plating. For example, at Large sizes of particles, approximately 1.0-5.0 μm, the sonication of the bath during plating decreased the signal to approximately 120 from an original signal of approximately 165 units magnitude (approximately a 30% decrease).

The approximately 0.5-1.0 μm luminescent particle size range (Medium size) behaved in a similar manner to the larger particle sizes under sonication, showing a dramatic decrease to approximately 184 from an original signal of approximately 1262 units magnitude (approximately an 85% decrease) in the signal when compared to silent conditions. The Small size, approximately 0.2-0.5 μm, particles showed no change in luminescent signal with respect to any change in sonication parameters.

As well as the luminescent signal strength, process considerations, such as sedimentation and fouling rates, were also altered by sonication of the plating solution. These factors are further discussed below.

Sonication of the plating solution was shown to inhibit the co-deposition of agglomerated luminescent particles within the plated metal matrix. If the colloid is sufficiently deagglomerated at a pre-plating stage (before commencing the plating process), few agglomerated luminescent particles were co-deposited under sonicated or silent (i.e., no sonication) plating conditions.

c. Effect of Pre-Plating Sonication of the Plating Solution

For particles in the Small size range of approximately 0.2-0.5 μm, pre-plating sonication (before commencing the plating process) had no effect on the luminescent signal strength. For the largest particles, approximately 5-10 μm and 10+ μm, pre-plating sonication may have little effect on the luminescent signal strength. However, at approximately 0.5-1.0 μm, the pre-plating sonication may increase the resultant luminescent signal level from the metal plated layer.

d. Sonication During the Initial Period of Time after Commencing the Plating Process FIG. 3 shows an image of a cross-section of an exemplary substrate (article) electroplated in accordance with embodiments of the present invention.

In FIG. 3, layer C denotes a portion of the substrate of the article, layer B denotes a portion of the initial luminescent-free layer of electroplated metal initially laid down during the plating process, and layer A denotes a portion of the electroplated layer having luminescent particles dispersed therein.

The extremely low luminescent particle content at the electroplate-substrate interface (which is inherent to any co-deposition process) may be significantly decreased when the ultrasound treatment (sonication) is applied for approximately the first 30 minutes of plating. This luminescent particle-free layer (layer B in FIG. 3) has been observed to reach up to approximately 2-4 μm in thickness. However, with application of sonication, it can be reduced (e.g., approximately 1 μm). The benefit of the application of sonication is a greater proportion of the plated layer with an ideal particle distribution and also a cost saving as less plate can be applied whilst still ensuring the same functional life-time expectations.

e. Physical Effect of Sonication on the Process

Sonication provides energy for dispersing the solid particulates in a suspension throughout the liquid phase (medium) of the plating solution. It was observed during the experiments that the suspension was much more uniform under sonicated conditions. Without the sonication, sedimentation of some of the solid particulates was observed in all low energy areas of the plating baths.

From the results it was observed that, without sonication, a relatively poor suspension and high rates of sedimentation for all particle sizes greater than approximately 1 μm was observed. At particle sizes less than approximately 1 μm, a reasonable suspension was possible, but this was always observed to be enhanced by sonication of the plating bath.

The pre-sonication of the plating bath (i.e., prior to commencing plating) proved to be the most effective. The best suspensions were formed at all particle sizes when the plating bath was sonicated (e.g., for approximately 5 hours) prior to plating as well as through the plating process (although this did not necessarily give the best signal strength in the final plated article).

Sonication performed solely during the plating process (i.e., no pre-plating sonication) did produce a reasonable suspension at particle sizes greater than approximately 1 μm, and a good suspension at particle sizes less than approximately 1 μm.

However, in all cases except the smallest (e.g., approximately 0.2-0.5 μm) particles, pre-sonication is more effective. This may be attributed to the fact that, while the plating solution remains un-agitated prior to plating, agglomerates of the luminescent particles are formed, which require more energy to dissociate than can be provided by solely providing sonication during the plating process.

The discrepancy at the smallest particle range (e.g., approximately 0.2-0.5 μm) has been attributed to an intrinsic property of all small particles (agglomerations are thermodynamically favorable as surface area and thus free energy are reduced). With the smallest particles trialed, this effect was exaggerated to the point where, without sonication during the trial, larger agglomerates immediately formed.

In all cases, sonication improved the condition of the plating bath (i.e., there was significantly less fouling of the pipework and plating bath and sedimentation with plating processes in which sonication was performed). Any sediment that did form during sonicated runs was easily removed with a jet of demineralised water. Sediment formed much more rapidly when the plating bath remained silent (no sonication), and the sediment formed a clay-like texture that was extremely difficult to fully remove. Sonication prior and throughout the plating process provided the best process conditions, but it was observed the pre-plating sonication was a more significant factor in preventing fouling, as most sediment is formed prior to plating while the plating bath is idle. The fouling and sedimentation has a negative effect on heat exchanger, pump, and filter efficiency.

f. Current Density

It was found that for the plating process, a very effective current density lay within the region of 0.3-1.0 A/dm$^2$. This takes into account both composite formation and matrix plating conditions. The current density used takes into account standard electroplating problems such as the throwing power (the ability of a plating solution to produce a relatively uniform distribution of metal upon a cathode of irregular shape). For this reason, the current density significantly depends on the geometry of the plated substrate (article).

g. Turbulence

During the experiments, turbulence in the plating bath was introduced (e.g., mixing using a stirrer and eductor system). The angular velocity of the stirrer, diameter of the stirrer, and the bath geometry affect the level of turbulence in the bath. It was found that the lower the revolutions per minute ("rpm") of the stirrer impeller, the higher the rate of sedimentation in the plating bath and the lower concentration of particulate matter in the bulk liquid phase. This worse suspension led to lower co-deposition levels and the previously mentioned process problems related to fouling.

Running the stirrer at a reasonable speed (e.g., less than the speed (critical angular velocity) where vortexes are formed), provided adequate stirring and maximum levels of co-deposition of the luminescent and metal particles in the plated layer. Increasing the stirrer speed beyond this critical angular velocity did not provide a measurably better suspension or increase the levels of co-deposition.

During the electroplating trials where the angular velocity of the stirrer was increased to give extremely high levels of turbulence, it was observed that—although a good suspension was present—the rates of co-deposition were low. It is believed that over agitation (e.g., angular velocity at a speed greater than where vortexes are formed in the plating bath) of the suspension removes the luminescent particles from the substrate surface being plated during the loose adsorption step of the co-deposition process. It is believed that this phenomenon was analogous to the decrease in levels of co-deposition seen in the electroplating trials where the plating bath was sonicated during plating.

Agitation of the plating bath helped to provide a better suspension, but sedimentation still occurred at a lower rate at all the stirrer speeds trialed. Once a sedimentation layer has been formed, the turbulence of the plating bath could not provide the energy required to redisperse the particulate matter. Sonication of the plating bath helps to break up the sediment layer and helps prevent its formation.

Reasonable levels of agitation (e.g., below the critical angular velocity) combined with sonication provided better process conditions. The sonication de-agglomerates the particles in the plating solution (making their effective particle diameter smaller and thus having a lower sedimentation rate) as well as breaking up any sediment. The mechanical agitation combined with the sonication provides the energy to disperse these particles and keep the plating bath in a good colloidal suspension.

h. Electrochemical Parameters

Different current densities were used during the electroplating trials, ranging from approximately 0.3-1.0 A/dm$^2$. The effect of current density on incorporation of particles was obfuscated by the significant change in throwing power.

The average plate thickness was measured from a random sample of 25 articles plated in the experiment. From this data, it was clear that the volume of co-deposited matter did not significantly alter the plate thickness.

The pre- and post-plating masses of the articles were recorded. The cathode efficiency determined using Faraday's law by comparison to ideal plating constants. It was determined that the presence of particulate matter had a negligible effect on the cathode efficiency.

i. Quality of Final Product

With respect to the production of coinage, the quality of the resultant electroplated finish on a coin that has been struck (i.e., stamped or patterned with the coin's final design) may be the ultimate determining factor for which electroplating parameters achieve a quality of finish on the surface of a struck coin that is acceptable for use in public commerce. Note, however, that the following discussion with respect to finish quality is not limited to the production of coinage, but may apply to any plated article where the quality of the finish of the surface is important to utilization of the plated article.

Figure 4:
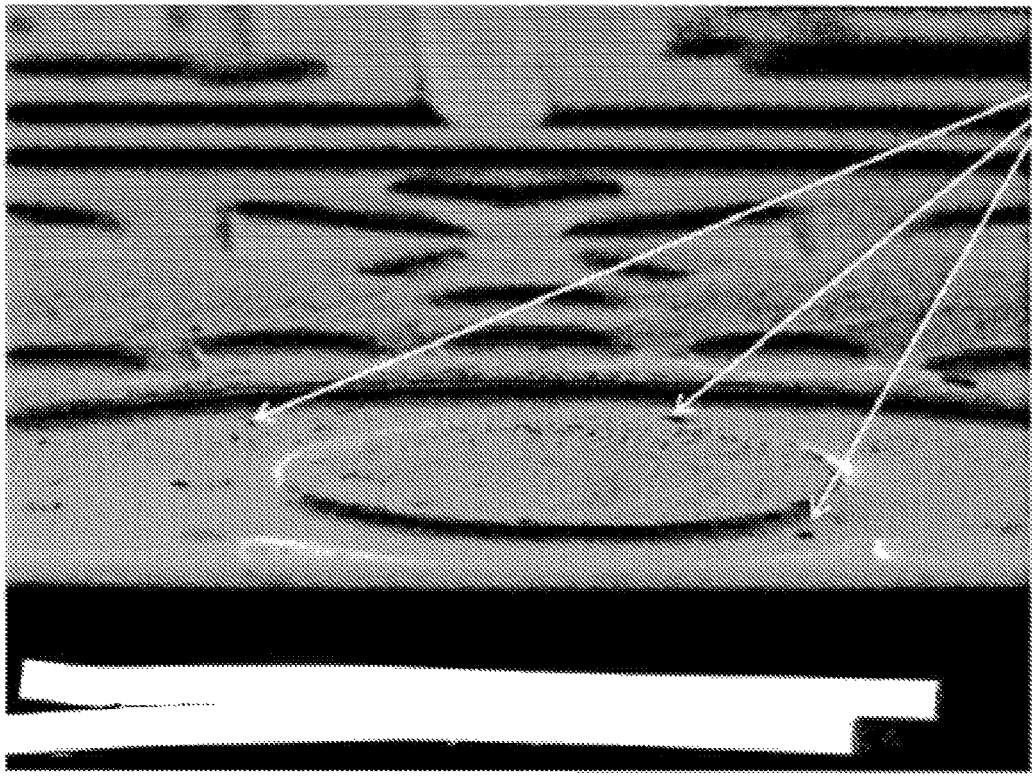
FIG. 4 shows a scanning electron micrograph of a surface of an electroplated and patterned article in which having luminescent particles having a diameter of approximately 5 μm or larger are dispersed in the electroplated layer.

The quality of the surface of a struck coin after being plated in accordance with embodiments of the present invention was observed to be a function of many of the variables. The luminescent particle size gave a very significant contribution to the plate quality and the resultant finish. Particles larger than approximately 5 μm seemed to decrease the quality of the surface finish, as can be seen in FIG. 4. In FIG. 4, the white arrows are pointing to some of the pitting on the surface of the plated article.

The highest quality plated articles were made with the smallest luminescent particle size (approximately 0.2-0.5 μm). The plated articles from the particle size range of approximately 0.5-1.0 μm were also very good.

Any agglomerates present gave a dramatic decrease in the surface quality of the finished plated article. As the agglomerates are embedded in the electroplated surface, they can break up causing pits on the surface of the finished plated article as shown in FIG. 4. This process may occur due to the fact that the particle-particle adhesion in agglomerates is very weak. In contrast, singular luminescent particles incorporated in the plated layer are held in place mechanically by the grain structure of the plated metal matrix, which makes for a stronger composite product with a superior surface finish. Therefore, smaller de-agglomerated particles are desired from a quality of finish perspective.

2. Conclusions a. Particle Size

A Medium luminescent particle size distribution of approximately 0.5 to 1.0 μm may produce an excellent quality of finish article (e.g., see FIG. 8) with high luminescent signal output under the correct process conditions. A good quality of finish on plated articles may be obtained with particles having a size of approximately 0.2 to 5.0 μm (e.g., see FIG. 7).

Luminescent particles above approximately 10.0 μm are not easily incorporated into the electrodeposited layer at the plate thicknesses trialed.

Luminescent particles above approximately 5.0 μm may produce a product with surface pitting (e.g., see FIG. 4).

The smaller the luminescent particle size, the more readily a good suspension is formed of the particles in a plating bath.

The smaller the particle size, the more susceptible the luminescent particles are to agglomerating.

Luminescent particles in the approximately 0.2-0.5 μm range spontaneously form agglomerations.

b. Sonication

Optimum sonication conditions were deduced. Excellent results were obtained when the plating bath was sonicated prior to initiating the plating process (e.g., for approximately 5 hours) and for the first minutes (e.g., 30) of plating. Other conclusions relating to sonication are outlined below.

Sonication aids the formation of a homogenous colloidal suspension of the particles in the plating bath.

Sonication of the plating bath during the first minutes (e.g., 30-60) of plating significantly reduces the thickness of the luminescent particle-free nucleation zone (e.g., layer B in FIG. 3).

Pre-sonication (e.g., for approximately 5 hours) significantly reduces the fouling of the plating process instruments and sedimentation (e.g., at the bottom of the plating vessel) that occurs during the plating process.

Sonication (e.g., for approximately 5 hours) before plating as well as during plating can be used to produce good colloidal suspensions from systems that, under silent conditions, would not form a stable suspension.

Sonication during the plating process inhibits the inclusion of luminescent particles into the metal matrix being plated on the article.

Sonication during the plating process is not as effective as pre-sonication (e.g., approximately 5 hours) at keeping a stable suspension. This was observed for all particle sizes, except for particles in the approximately 0.2-0.5 μm range.

c. Turbulence

With respect to agitation (degree of turbulence), very good conditions for the process were found to be a stirrer (e.g., overhead type) set to an rpm that stirred the plating bath just below the critical angular velocity for producing a vortex (which may be combined with a recirculation stream for the low energy areas). Mechanical bath agitation combined with sonication provided excellent process conditions. Other conclusions are summarised below.

The higher the degree of turbulence, the lower the rate of sedimentation in the plating bath, and the higher the concentration of luminescent particulate matter in the plating solution.

Increasing turbulence increased the degree of co-deposition of luminescent particles up to a critical point. Beyond the critical point, the degree of co-deposition did not increase, and in fact decreased at extremely high levels of turbulence.

If a layer of sedimentation is formed, turbulence alone cannot return the particulate matter into suspension.

Reasonable levels of turbulence combined with sonication provided an excellent suspension.

d. Electrochemical Parameters

Any change in cathode efficiency caused by the presence of particulate matter within the plating solution was immeasurable and therefore insignificant.

Particulate material could be co-deposited from each of the current densities trialed.

There was no measurable change in plate thickness between a composite and pure metal product.

Example 2

The present inventors also have carried out an alternative plating process that uses a high shear pump instead of ultrasound. In this alternative plating process, the plating solution, during plating, was diverted from the plating bath, passed through a high shear centrifugal pump, then recirculated to the plating bath.

The experimental setup of the equipment is the same as for Example 1 except the recirculation pump has been replaced by a high shear pump and the sonotrode is not used. An example of the equipment can be seen in FIG. 12.

Figure 12:
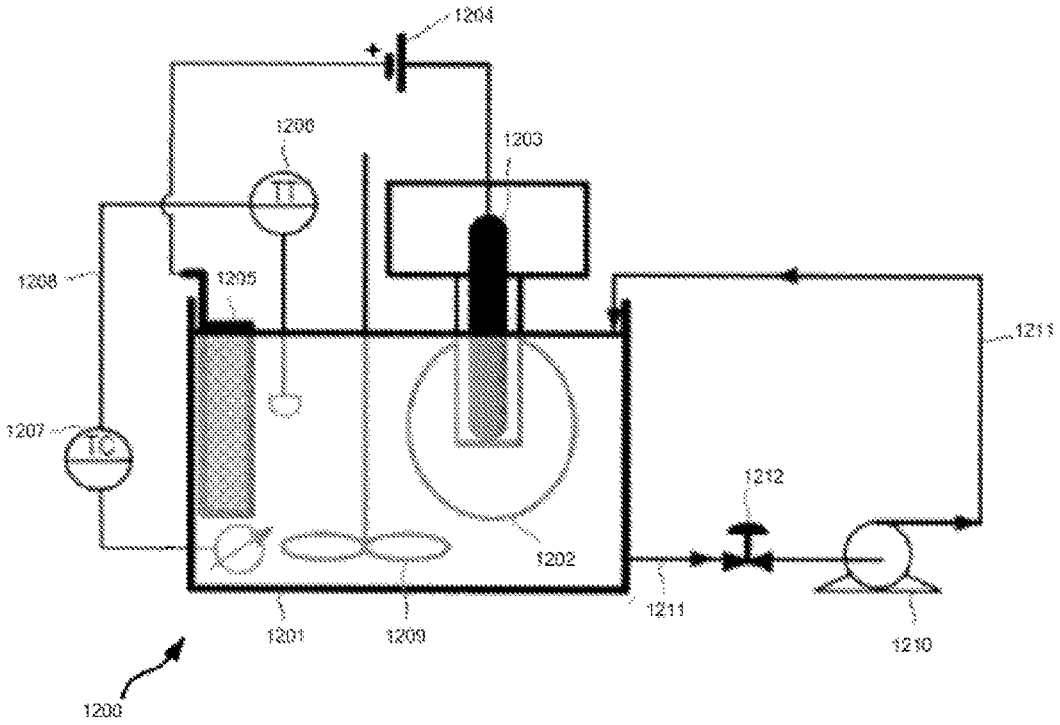
FIG. 12 shows schematically an example of an apparatus for carrying out embodiments of plating processes described herein, as described in Example 2 below.

FIG. 12 illustrates schematically an apparatus 1200 that may be used for carrying out the plating process. The apparatus 1200 includes a receptacle 1201 for retaining the plating solution, a tumbler (e.g. rotary) 1202 for tumbling the articles within the plating solution during plating process, an electrode 1203 that acts as a cathode during the plating process, this electrode extending into the barrel of the rotary tumbler, a power source 1204, a further electrode 1205 (e.g., in the form of a basket), which acts as an anode during the plating process, a temperature transmitter ("TT") device 1206 for temperature measurement (e.g. at pt100 sensor) which is linked via a connector 1208 to a temperature controller ("TC") device 1207, a stirrer 1209, a high shear pump 1210 that circulates plating solution (for example around a conduit 1211 and valve 1212, which maybe a pneumatic valve).

Figure 13:
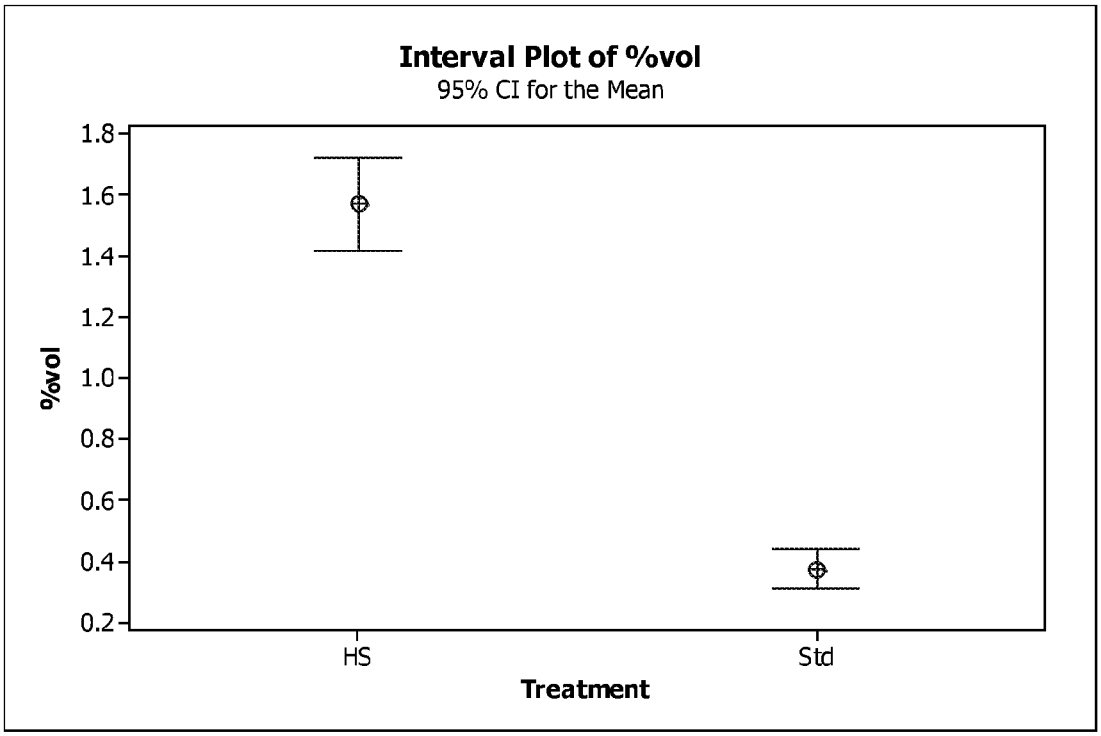
FIG. 13 shows some results from Example 2 below, in particular a comparison of percentage incorporation of luminescent particles under a process that involved use of a high shear pump using the apparatus of FIG. 12, and a process that did not use a high shear pump.

The de-agglomeration chamber can be either set up as a rotor stator or as a simple impeller; the results below are using a rotor stator. The plating parameters were very similar to those mentioned above for the technique that used ultrasound (Example 1), so they will not be further described here. In the following, we describe the use of the high shear pump apparatus, and the parameters employed. The high shear inlet pipe is connected directly to the outlet on the side of the tank the return leg is fed over the side of the tank. The high shear pump was operated with a tip speed (circumferential speed of impeller) of 25 m/s and at a bath turnover rate of 7.5 bath volume/hr. The high shear pump is used continuously during plating runs to ensure maximum de-agglomeration. The results in FIG. 13 show a comparison trial which compares ultrasonic de-agglomeration prior to plating (not during plating as it negatively affects incorporation) with high shear de-agglomeration during plating. FIG. 13 shows a comparison of percentage incorporation under high shear (HS) and standard (std) run conditions (i.e. without high shear)

It can be clearly seen in FIG. 13 that the volume percent of the deposit occupied with taggant increased under the high shear treatment. Under the standard run conditions, the mean volume percentage of incorporation was determined to be 0.37% vol. While using the high shear setup, the mean volume percentage of incorporation was determined to be 1.57% vol.

We claim:

1. A method for plating articles, the method comprising:

providing a plating solution comprising a liquid medium, a precursor species suitable for forming a metallic layer on the articles, and a plurality of luminescent particles suspended in the liquid medium, at least some of which have a diameter of 10 μm or less; wherein the luminescent particles comprises a yttrium aluminum garnet (YAG), doped with a metal selected from a transition metal, a lanthanide and an actinide, wherein the luminescent particles have a D50 distribution, measured using laser light scattering, in accordance with ASTM UOP856-07, of 10 μm or less; and plating the articles within the plating solution, such that the precursor species forms the metallic layer on the articles and the luminescent particles are deposited within the metallic layer while it is formed; and wherein the plating is carried out while the articles are within a receptacle that moves continuously during the plating process, and the plating process is an electroplating process; and wherein the articles are removed from the receptacle, dried and not further plated, such that the metallic layer containing the luminescent particles is an outer layer and the particles are detectable for security purposes.

2. A method according to claim 1, wherein the luminescent particles have a D50 distribution, measured using laser light scattering, in accordance with ASTM UOP856-07, of 0.5 to 5 μm.

3. A method according to claim 1, wherein the luminescent particles have a D50 distribution, measured using laser light scattering, in accordance with ASTM UOP856-07, of from 0.5 μm to 2 μm.

4. A method according to claim 1, wherein the plating is carried out while the articles are within the receptacle that moves continuously during the plating process and is placed within a container of plating solution, and the plating solution, before and/or during the plating, is circulated from the container of plating solution to an agitation unit, in which the plating solution is agitated, and then returned to the container of plating solution.

5. A method according to claim 4, wherein the agitation unit is or comprises a centrifugal pump.

6. A method according to claim 4, wherein the agitation involves rotating an impeller within the plating solution in the agitation unit at a tip speed of from 5 m/s to 50 m/s.

7. A method according to claim 4, wherein at least some of the plurality of the luminescent particles have a diameter of 0.5 μm to 1 μm.

8. A method according to claim 4, wherein the luminescent particles have a D90 distribution, measured using laser light scattering, in accordance with ASTM UOP856-07, of 5 μm or less.

9. A method according to claim 4, wherein the luminescent particles have a D90 distribution, measured using laser light scattering, in accordance with ASTM UOP856-07, of 1 μm to 3 μm.

10. A method according to claim 4, wherein the receptacle rotates at a speed of from 1 to 15 rpm.

11. A method according to claim 1, wherein the articles comprise metallic discs.

12. A method according to claim 1, further comprising applying a potential to effect the plating of the articles, wherein a current density while plating the articles is from 0.1 $A/dm^2$ to 1.5 $A/dm^2$.

13. A method according to claim 1, wherein the articles comprise steel, and the metallic layer comprises a metal selected from zinc, copper, nickel, and alloys of one or more thereof.

14. A method according to claim 1, wherein the plurality of the luminescent particles comprise an up-converting or down-converting phosphor material and the luminescent particles have a density of at least 4 kg/dm3.

15. A method according to claim 1, wherein the plating of the articles is continued until the metallic layer has a depth of from approximately 10 to 30 μm.

16. A method of claim 1 further comprising:

after removal from the receptacle, and prior to or after drying, stamping a pattern into at least one surface of at least some of the plated articles.

17. A method according to claim 16, wherein the articles, before being plated, comprise metallic discs.

18. A method according to claim 1, wherein the luminescent particles have a D90 distribution, measured using laser light scattering, in accordance with ASTM UOP856-07, of 5 μm or less.

19. A method according to claim 1, wherein the luminescent particles have a D90 distribution, measured using laser light scattering, in accordance with ASTM UOP856-07, of 1 μm to 3 μm.

20. A method according to claim 1, wherein the receptacle rotates at a speed of from 1 to 15 rpm.

* * * * *